US011737514B2

(12) United States Patent
Lyke

(10) Patent No.: US 11,737,514 B2
(45) Date of Patent: Aug. 29, 2023

(54) SOLE STRUCTURE FOR ARTICLE OF FOOTWEAR

(71) Applicant: NIKE, Inc., Beaverton, OR (US)

(72) Inventor: Christopher J. Lyke, Portland, OR (US)

(73) Assignee: NIKE, Inc.

( * ) Notice: Subject to any disclaimer, the term of this patent is extended or adjusted under 35 U.S.C. 154(b) by 6 days.

(21) Appl. No.: 17/331,320

(22) Filed: May 26, 2021

(65) Prior Publication Data

US 2021/0368918 A1 Dec. 2, 2021

Related U.S. Application Data

(60) Provisional application No. 63/032,662, filed on May 31, 2020.

(51) Int. Cl.
*A43B 13/18* (2006.01)

(52) U.S. Cl.
CPC ..... *A43B 13/181* (2013.01)

(58) Field of Classification Search
CPC ..... A43B 13/181; A43B 13/36; A43B 13/12; A43B 13/189; A43B 13/20; A43B 13/223; A43B 3/246
See application file for complete search history.

(56) References Cited

U.S. PATENT DOCUMENTS 5,343,639 A * 9/1994 Kilgore ..... A43B 13/183 36/35 B
5,743,028 A * 4/1998 Lombardino ..... A43B 21/28 36/38
6,311,413 B1 11/2001 Chern et al.
6,568,102 B1 * 5/2003 Healy ..... A43B 13/20 36/35 R
9,339,079 B2 * 5/2016 Lucas ..... A43B 13/187
9,345,285 B2 * 5/2016 Lucas ..... A43B 13/181
(Continued)

FOREIGN PATENT DOCUMENTS

DE 202017101310 U1 5/2017
WO WO-2004082416 A1 9/2004

OTHER PUBLICATIONS

European Patent Office, PCT International Search Report and Written Opinion dated Aug. 31, 2021 for application No. PCT/US2021/034303.

*Primary Examiner* — Bao-Thieu L Nguyen
(74) *Attorney, Agent, or Firm* — Honigman LLP; Matthew H. Szalach; Jonathan P. O'Brien

(57) ABSTRACT

An article of footwear includes a sole structure having a chassis, an outsole, and a cushioning element. The chassis extending from an anterior end to a posterior end and includes a dock formed between the anterior end and the posterior end. The outsole extends from a first end removably coupled to the anterior end of the chassis to a second end removably coupled to the posterior end of the chassis. The cushioning element is disposed between the chassis and the outsole and includes a first portion removably engaged with the dock of the chassis. The sole structure may include a carriage removably disposed between the chassis and the outsole adjacent to the cushioning element. The carriage includes an upper frame receiving and surrounding the dock and a lower frame receiving and surrounding a portion of the outsole.

20 Claims, 18 Drawing Sheets

(56) References Cited

U.S. PATENT DOCUMENTS 9,491,984 B2 * 11/2016 Peyton ..... A43B 13/20
10,143,264 B2 * 12/2018 Lucas ..... A43B 13/186
10,143,265 B2 * 12/2018 Lucas ..... A43B 13/12
10,758,002 B2 * 9/2020 DeVoe ..... B29D 35/142
D912,949 S * 3/2021 Troufanov ..... D2/947
11,311,076 B2 * 4/2022 Troufanov ..... A43B 13/127
2002/0178620 A1 * 12/2002 Asciolla ..... A43B 13/36 36/15
2004/0088883 A1 * 5/2004 Workman ..... A43B 3/18 36/62
2004/0194347 A1 * 10/2004 Aveni ..... A43B 7/1464 36/91
2005/0102859 A1 * 5/2005 Yen ..... A43B 21/28 36/27
2006/0191162 A1 * 8/2006 Aveni ..... A43B 13/181 36/28
2007/0256326 A1 * 11/2007 Jarvis ..... A43B 13/226 36/35 R
2009/0064542 A1 * 3/2009 Figueroa ..... A43B 13/187 36/7.4
2010/0071228 A1 * 3/2010 Crowley, II ..... A43B 13/181 36/28
2010/0107444 A1 * 5/2010 Aveni ..... A43B 13/189 36/35 B
2011/0138652 A1 * 6/2011 Lucas ..... A43B 13/14 36/28
2012/0117824 A1 * 5/2012 Kim ..... A43B 13/182 36/105
2013/0160324 A1 * 6/2013 Peyton ..... A43B 7/32 36/83
2013/0239443 A1 * 9/2013 Lin ..... A43B 7/08 36/3 B
2016/0058124 A1 * 3/2016 Lucas ..... A43B 7/144 36/28
2016/0255909 A1 * 9/2016 Lucas ..... A43B 21/32
2017/0013911 A1 * 1/2017 Lucas ..... A43B 13/188
2017/0013914 A1 * 1/2017 DeVoe ..... A43B 7/16
2018/0242686 A1 8/2018 Pilto et al.
2020/0297071 A1 * 9/2020 Troufanov ..... A43B 13/188
2020/0375306 A1 * 12/2020 DeVoe ..... A43B 13/02
2021/0030112 A1 * 2/2021 Amoako ..... A43B 13/186
2021/0368921 A1 * 12/2021 Campos, II ..... A43B 13/189
2021/0368922 A1 * 12/2021 Ho ..... A43B 13/125

* cited by examiner

SOLE STRUCTURE FOR ARTICLE OF FOOTWEAR

CROSS REFERENCE TO RELATED APPLICATIONS

This application claims priority under 35 U.S.C. § 119(e) to U.S. Provisional Application No. 63/032,662, filed on May 31, 2020. The disclosure of this prior application is considered part of the disclosure of this application and is hereby incorporated by reference in its entirety.

FIELD

The present disclosure relates generally to articles of footwear, and more particularly, to sole structures for articles of footwear.

BACKGROUND

This section provides background information related to the present disclosure, which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally incorporate a fluid-filled bladder to provide cushioning to the foot by compressing resiliently under an applied load to attenuate ground-reaction forces. Sole structures may also include a comfort-enhancing insole or sockliner located within a void proximate to the bottom portion of the upper and a strobel attached to the upper and disposed between the midsole and the insole or sockliner.

Midsoles employing bladders typically include a bladder formed from two barrier layers of polymer material that are sealed or bonded together. The bladders may contain air, and are designed with an emphasis on balancing support for the foot and cushioning characteristics that relate to responsiveness as the bladder resiliently compresses under an applied load.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
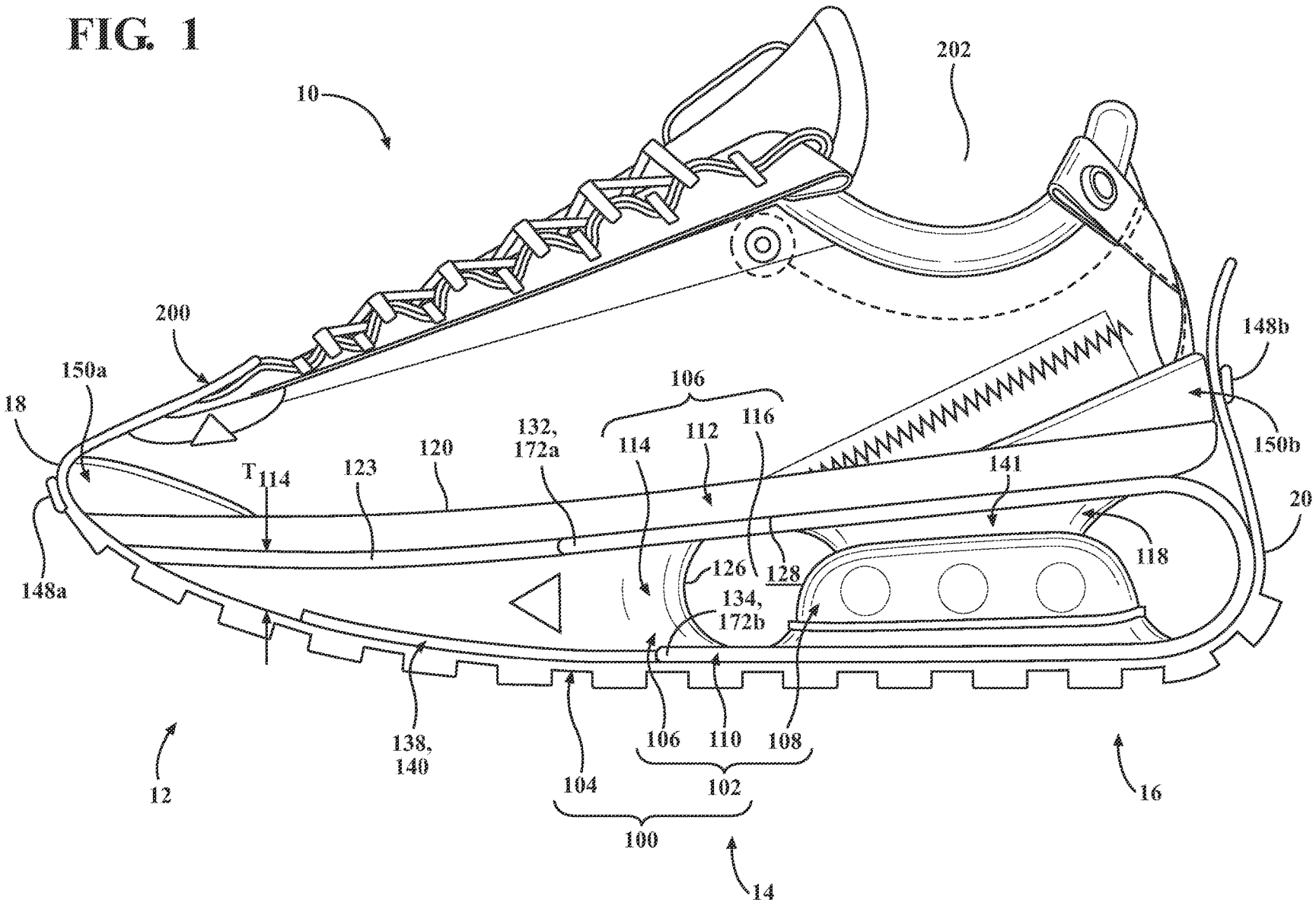
FIG. 1 is a lateral side elevation view of an article of footwear including a sole structure in accordance with principles of the present disclosure.
Figure 2:
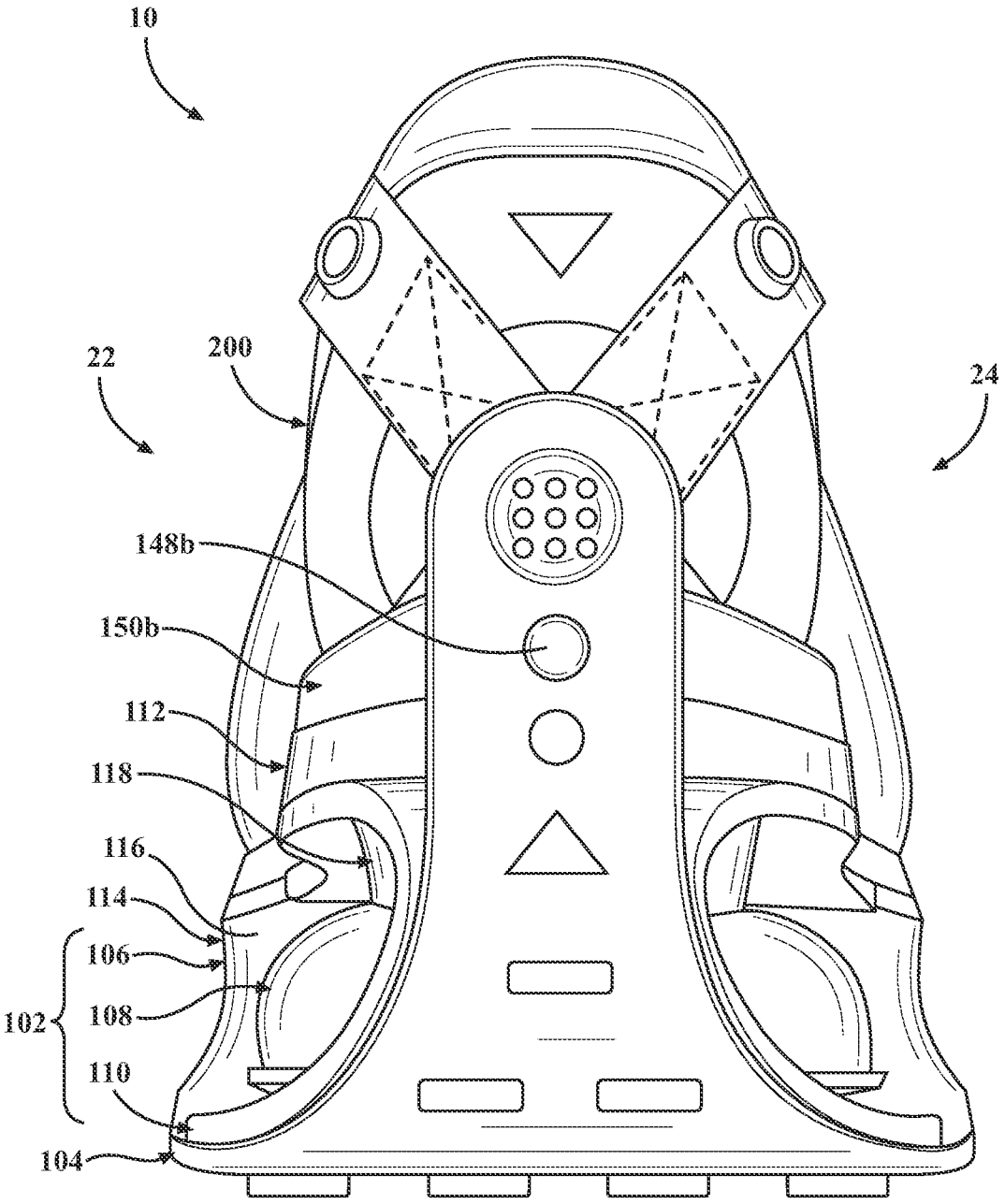
FIG. 2 is a posterior elevation view of the article of footwear of FIG. 1.
Figure 3:
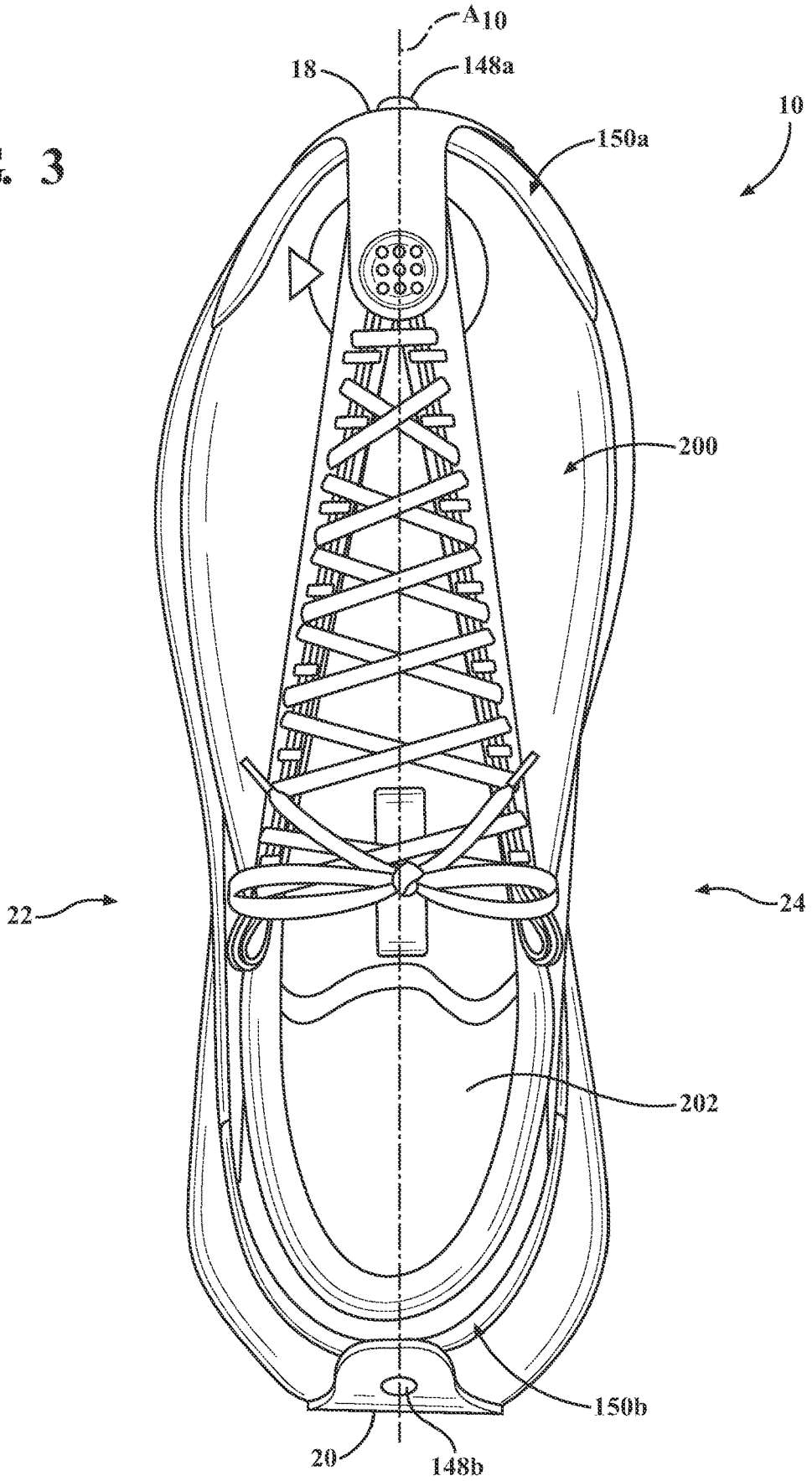
FIG. 3 is a top plan view of the article of footwear of FIG. 1.
Figure 4:
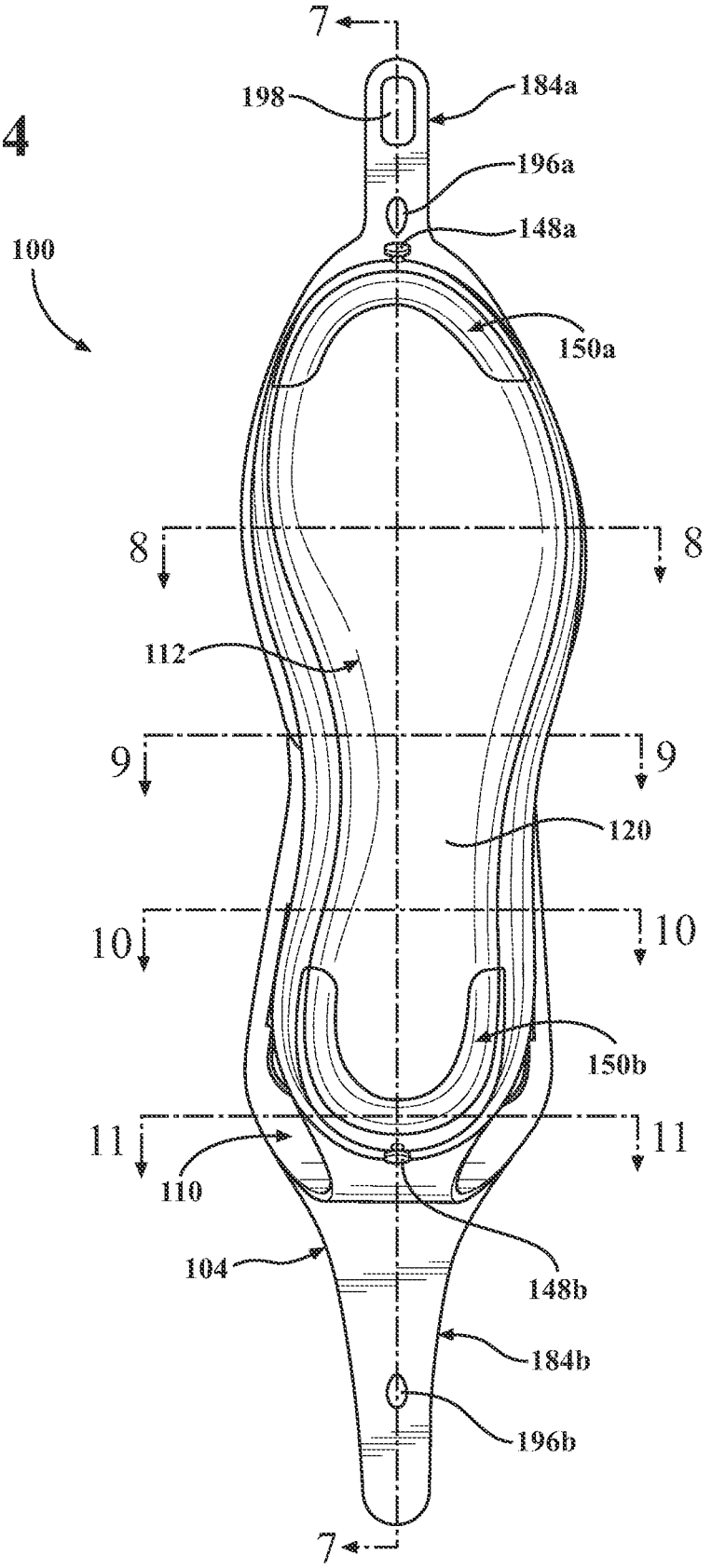
FIG. 4 is a top plan view of a sole structure of an article of footwear in accordance with the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a sole structure for an article of footwear having an upper. The sole structure includes a chassis extending from an anterior end to a posterior end and including a dock formed between the anterior end and the posterior end, an outsole extending from a first end removably coupled to the anterior end of the chassis to a second end removably coupled to the posterior end of the chassis, and a cushioning element disposed between the chassis and the outsole and including a first portion removably engaged with the dock of the chassis. Implementations of the disclosure may include one or more of the following optional features.

In some examples, the sole structure further includes a carriage removably disposed between the chassis and the outsole adjacent to the cushioning element. Here, the carriage may include an upper frame engaged with the chassis and a lower frame engaged with the outsole. Optionally, the upper frame surrounds the dock and/or the lower frame surrounds a portion of the outsole. In some implementations, the outsole includes a cradle formed between the first end and the second end, and a lower portion of the cushioning element is removably engaged with the cradle.

In some configurations, the chassis includes a support member spaced apart from the dock. The support member includes a plurality of first engagement features and the outsole includes a plurality of second engagement features selectively engaged with the first engagement features. Here, the first engagement features may be one of pins or apertures and the second engagement features are the other of pins or apertures. Optionally, the pins include barbs.

In some examples, the anterior end of the chassis includes a first fixture for selectively attaching the first end of the outsole to the chassis and the posterior end of the chassis includes a second fixture for selectively attaching the second end of the outsole to the chassis.

In another aspect of the disclosure, a sole structure for an article of footwear having an upper is provided. The sole structure includes a chassis having a first portion forming a support member and a second portion defining a recess. The chassis has a dock disposed within the recess. The sole structure further includes an outsole extending from a first end removably coupled to the chassis adjacent to the first portion to a second end removably coupled to the chassis adjacent to the second portion. The sole structure also includes a cushioning element disposed within the recess and including an upper portion removably engaged with the dock and a lower portion removably engaged with the outsole.

In some examples, the sole structure includes a carriage removably disposed between the chassis and the outsole adjacent to the cushioning element. Here, the carriage may include an upper frame engaged with the chassis and a lower frame engaged with the outsole. Optionally, the upper frame surrounds the dock and/or the lower frame surrounds a portion of the outsole.

In some examples, the outsole includes a cradle formed between the first end and the second end. Here, the first portion of the cushioning element is removably engaged with the cradle.

In some examples, the support member includes a plurality of first engagement features and the outsole includes a plurality of second engagement features selectively engaged with the first engagement features. The first engagement features may be one of pins or apertures and the second engagement features may be the other of pins or apertures. Optionally, the pins include barbs.

In some implementations, the first portion of the chassis includes a first fixture for selectively attaching the first end of the outsole to the chassis and the second portion of the chassis includes a second fixture for selectively attaching the second end of the outsole to the chassis.

The details of one or more implementations of the disclosure are set forth in the accompanying drawings and the description below. Other aspects, features, and advantages will be apparent from the description and drawings, and from the claims.

Figure 5:
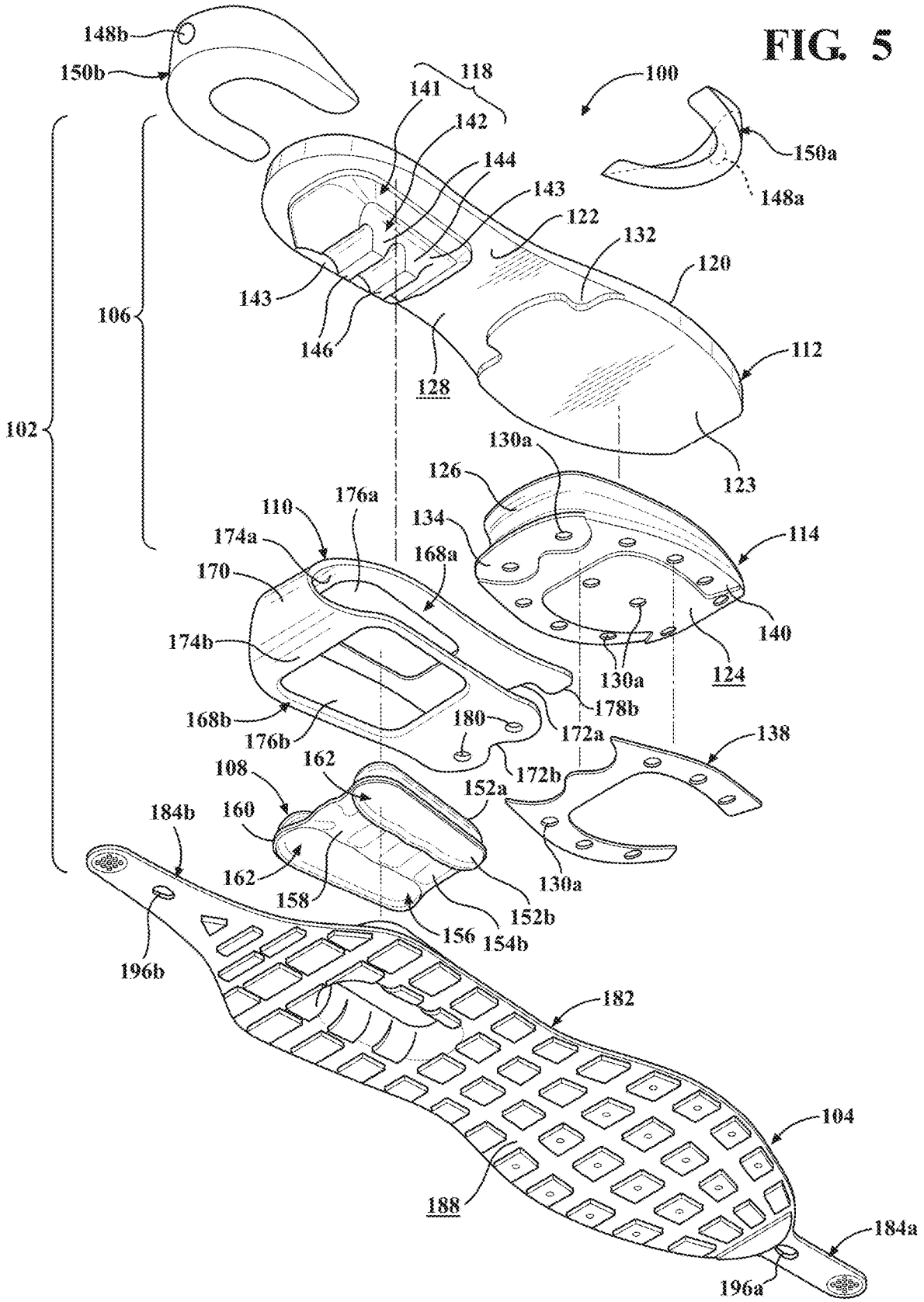
FIG. 5 is a bottom perspective exploded view of the sole structure of FIG. 4.

Referring to FIGS. 1-4, an article of footwear 10 is provided, which includes a sole structure 100 and an upper 200 attached to the sole structure 100. The article of footwear 10 may be divided into one or more regions. The regions may include a forefoot region 12, a mid-foot region 14, and a heel region 16. The forefoot region 12 corresponds to the phalanges and the metatarsophalangeal joint (i.e., "the ball") of the foot. The mid-foot region 14 may correspond with an arch area of the foot, and the heel region 16 may correspond with rear portions of the foot, including a calcaneus bone. The footwear 10 may further include an anterior end 18 associated with a forward-most point of the forefoot region 12, and a posterior end 20 corresponding to a rearward-most point of the heel region 16. A longitudinal axis A10 of the footwear 10 extends along a length of the footwear 10 from the anterior end 18 to the posterior end 20, and generally divides the footwear 10 into a lateral side 22 and a medial side 24, as shown in FIG. 5. Accordingly, the lateral side 22 and the medial side 24 respectively correspond with opposite sides of the footwear 10 and extend through the regions 12, 14, 16.

The sole structure 100 includes a midsole 102 configured to provide cushioning characteristics to the sole structure 100, and an outsole 104 configured to provide a ground-engaging surface of the article of footwear 10. Unlike conventional sole structures, the midsole 102 of the sole structure 100 may be formed compositely and include a plurality of subcomponents for providing desired forms of cushioning and support throughout the sole structure 100. For example, the midsole 102 may be described as including a chassis 106 and a cushioning element 108, where the chassis 106 is configured to provide an interface for removably attaching the cushioning element 108 to the article of footwear 10. The sole structure 100, and more particularly, the midsole 102, may further include an interchangeable carriage 110 configured to be inserted between the chassis 106 and the outsole 104 in the heel region 16. Additionally, the components of the sole structure 100 are provided in a modular configuration, wherein each of the outsole 104, the cushioning element 108, and the carriage 110 is selectively attachable to the chassis 106 so that the sole structure 100 can be reconfigured by a user.

With reference to FIG. 1, the chassis 106 of the midsole 102 extends continuously from the anterior end 18 to the posterior end 20. An upper portion of the chassis 106 includes a footbed 112 configured to attach to the upper 200 and to provide support and cushioning for a plantar surface of the foot. A lower portion of the chassis 106 includes a support member 114 formed in the forefoot region 12 and the mid-foot region 14, and a recess 116 extending through the mid-foot region 14 and the heel region 16. As discussed below, the support member 114 is configured to provide cushioning along the forefoot region 12, while the recess 116 is configured to receive the bladder 108 and the carriage 110 for supporting the heel region 16 of the upper 200. The chassis 106 also includes a dock 118 protruding from the footbed 112 within the recess 116. The dock 118 is configured to interface with the bladder 108 to removably secure a position of the bladder 108 within the recess 116 when the sole structure 100 is assembled.

The footbed 112 extends continuously from the anterior end 18 to the posterior end 20 and includes a top side 120 of the chassis 106 configured to face the upper 200 when the article of footwear 10 is assembled. The footbed 112 also includes a bottom side 122 formed on an opposite side from the top side 120, where a distance between the top side 120 and the bottom side 122 forms a thickness of the footbed 112. The footbed 112 may include one or more resilient polymeric materials for providing cushioning and support along the plantar surface of the foot.

As shown, the support member 114 depends from the bottom side 122 of the footbed 112 and defines a bottom surface 124 of the chassis 106. Here, the support member 114 extends continuously from the anterior end 18 to an end wall 126 formed in the mid-foot region 14. A thickness $T_{114}$ of the support member 114 progressively increases along a direction from the anterior end 18 to the end wall 126. The recess 116 is defined by a recessed surface 128 that is offset from the bottom surface 124 and extends continuously from the end wall 126 through the posterior end 20. In the illustrated example, the recessed surface 128 is defined by the bottom side 122 of the footbed 112. However, in other examples, the recessed surface 128 may be spaced apart from the bottom side of the footbed 112.

In the illustrated example, the support member 114 is shown as a separate component attached to the footbed 112 on the bottom side 122. Accordingly, the support member 114 may include different materials than the footbed 112 for providing different cushioning and performance characteristics on a lower portion of the chassis 106. For instance, the footbed 112 may include a material having a different durometer to provide a greater degree of cushioning along the plantar surface of the foot. In other examples, the footbed 112 and the support member 114 may be formed of the same material and/or may be integrally formed as a single piece.

As shown in FIG. 5, the bottom surface 124 of the support member 114 may include one or more engagement features 130*a* configured to cooperate with corresponding engagement features 130*b* of the outsole 104 to secure a relative position of the outsole 104 with respect to the chassis 106 in the forefoot region 12. In the illustrated example, the engagement features 130*a* of the support member 114 include a plurality of apertures configured to receive corresponding pins 130*b* formed on the outsole 104. Additionally or alternatively, the support member 114 may include pins configured to engage corresponding apertures formed in the outsole 104.

The chassis 106 further includes a first receptacle 132 for engaging an upper portion of the carriage 110 and a second receptacle 134 for engaging a lower portion of the carriage 110. The first receptacle 132 includes a slot 132 extending between the footbed 112 and the support member 114 at the end wall 126. In the illustrated example, the slot 132 is formed in the bottom side 122 of the footbed 112. Particularly, the footbed 112 may include a boss 123 protruding from the bottom side 122. When the chassis 106 is assembled, the support member 114 attaches to the boss 123 such that the slot 132 is formed between the bottom side 122 and the support member 114. Alternatively, the slot 132 may be formed through the end wall 126 of the support member 114 adjacent to the bottom side 122 of the footbed 112. In the illustrated example, the end wall 126 has a convex profile from the lateral side 22 to the medial side 24. Likewise, the slot 132 extends along a convex path from the lateral side 22 to the medial side 24 and is configured to receive a corresponding concave end of the upper portion of the carriage 110.

The second receptacle 134 is formed as a notch 134 in the bottom surface 124 adjacent to the end wall 126 of the support member 114. Here, the notch 134 may include one or more of the first engagement features 130*a* configured to engage corresponding second engagement features 130*b* of the outsole 104 through the carriage 110. For instance, the pins 130*b* of the outsole 104 may extend through the carriage 110 and into the apertures 130*a* formed in the notch 134. Thus, when the sole structure 100 is assembled, the lower portion of the carriage 110 is received within the notch 134 between the chassis 106 and the outsole 104, and a position of the lower portion of the carriage 110 is fixed relative to the chassis 106 by the engagement features 130*a*, 130*b*.

Optionally, the sole structure 100 may include a horseshoe-shaped brace 138 disposed between the bottom surface 124 of the support member 114 and the outsole 104. When the brace 138 is included in the sole structure 100, the bottom surface 124 of the support member 114 may include a corresponding channel 140 for receiving the brace 138 within the support member 114. A depth of the channel 140 corresponds to a thickness of the brace 138, such that the brace 138 will be flush with the bottom surface 124 when the sole structure 100 is assembled. In some examples, the brace 138 may be attached to the support member 114 within the channel 140 to provide reinforcement and force dissipation around the perimeter of the support member 114. In other examples, the brace 138 may be attached to the outsole 104. Here, the brace 138 also provides reinforcement and force dissipation along the perimeter of the support member 114, and may also minimize peeling or rolling of the peripheral edge of the outsole 104.

In the heel region 16, the chassis 106 includes the dock 118 extending into the recess 116 from the recessed surface 128 (i.e., the bottom side 122 of the footbed 112). The dock 118 is configured to selectively engage the bladder 108 to secure a portion of the bladder 108 when the sole structure 100 is assembled. Particularly, the dock 118 interfaces with an upper portion of the bladder 108 within the recess 116 to restrict lateral and longitudinal movement of the bladder 108 within the recess 116. In the illustrated example, the dock 118 includes an abutment 141 extending from the recessed surface 128 and an upper spine 142 extending from a central portion of the abutment 141. The dock 118 defines a pair of upper channels 143 extending along opposite sides of the upper spine 142. The upper spine 142 is configured to interface with an upper pocket 154*a* of the bladder 108, while the upper channels 143 receive respective cushions 162 of the bladder 108. As shown, the upper spine 142 has a series of elongate ribs 144 each protruding from the upper spine 142 to a respective distal end 146. Each of the ribs 144 extends in a lateral direction (i.e., from the lateral side 22 to the medial side 24) across the sole structure 100. The ribs 144 are arranged in series along the direction of the longitudinal axis $A_{10}$ of the footwear 10. As discussed below, the ribs 144 cooperate with corresponding recesses formed in the upper portion of the bladder 108 to retain a position of the bladder 108 relative to the chassis 106.

The chassis 106 further includes a pair of fixtures or attachment points 148*a*, 148*b* disposed at opposite ends of the chassis 106. Particularly, the chassis 106 includes an anterior attachment point 148*a* disposed at the anterior end 18 and a posterior attachment point 148*b* disposed at the posterior end 20. In the illustrated example, the attachment points 148*a*, 148*b* are embodied as pins 148*a*, 148*b* extending from each of the anterior end 18 and the posterior end 20. As discussed below, the attachment points 148*a*, 148*b* are configured to selectively secure opposite ends of the outsole 104 to the midsole 102 and, as such, are configured to provide a rigid interface between the outsole 104 and the midsole 102 at each end 18, 20.

In some instances, the attachment points 148*a*, 148*b* may be formed separately from the chassis 106 and include a different material than the chassis 106. For example, each of the illustrated attachment points 148*a*, 148*b* is formed as part of a respective clip 150*a*, 150*b* attached to the top side 120 of the footbed 112. The clips 150*a*, 150*b* include a toe clip 150*a* extending around the anterior end 18 and a heel clip 150*b* extending around the posterior end 20. Here, each of the clips 150*a*, 150*b*, and particularly, the attachment points 148*a*, 148*b*, includes a material having a greater hardness than the material of the footbed 112.

As described above, the elements 112, 114, 116 of the chassis 106 include resilient polymeric materials, such as foam or rubber, to impart properties of cushioning, responsiveness, and energy distribution to the foot of the wearer. Example resilient polymeric materials for the chassis 106 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a cross-linking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

Generally, the cushioning element 108 of the sole structure 100 is supported within the heel region 16 of the chassis 106 and is configured to attenuate forces associated with impacts in the heel region 16. In the illustrated example, the cushioning element 108 includes an upper portion 152*a* defining an upper pocket 154*a* and a lower portion 152*b* defining a lower pocket 154*b*. As described in greater detail below, the upper portion 152*a* of the cushioning element 108 is configured to selectively interface with the dock 118 of the chassis 106 to removably secure a position of the cushioning element 108 relative to the chassis 106, while the lower portion 152*b* of the cushioning element 108 is configured to selectively engage a portion of the outsole 104 to removably secure a position of the cushioning element 108 relative to the outsole 104. Accordingly, when the sole structure 100 is assembled the relative positions of the outsole 104 and the chassis 106 may be maintained via mutual engagement with the bladder 108.

In some examples, the cushioning element 108 may be formed of a resilient polymeric material, such as a foam material. In the illustrated example, the cushioning element 108 of the midsole 102 is formed as a bladder 108. Here, the upper and lower portions 152*a*, 152*b* of the cushioning element 108 are formed by an opposing pair of barrier layers 152*a*, 152*b*, which are joined to each other at discrete locations to define a chamber 156, a web area 158, and a peripheral seam 160. In the illustrated configuration, the barrier layers 152*a*, 152*b* include a first, upper barrier layer 152*a* and a second, lower barrier layer 152*b*. Alternatively, the chamber 156 can be produced from any suitable combination of one or more barrier layers, as described in greater detail below.

In some implementations, the upper barrier layer 152*a* and the lower barrier layer 152*b* cooperate to define a geometry (e.g., thicknesses, width, and lengths) of the chamber 156. For example, the web area 158 and the peripheral seam 160 may cooperate to bound and extend around the chamber 156 to seal the fluid (e.g., air) within the chamber 156. Thus, the chamber 156 is associated with an area of the cushioning element 108 where interior surfaces of the upper and lower barrier layers 152*a*, 152*b* are not joined together and, thus, are separated from one another. Thicknesses $T_{108}$ of the bladder 108 are defined by the distance between the upper and lower barrier layers 152*a*, 152*b*.

Figure 7:
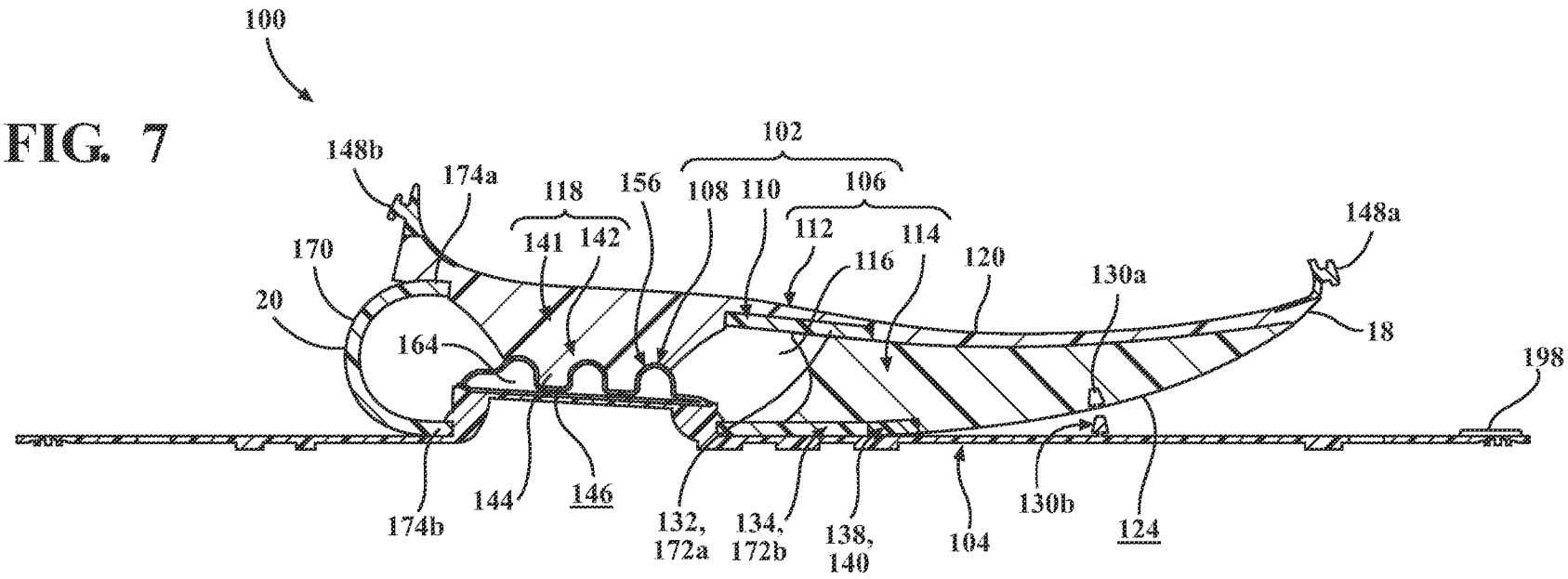
FIG. 7 is a cross-sectional view of the sole structure of FIG. 4, taken along Line 7-7 in FIG. 4.
Figure 8:
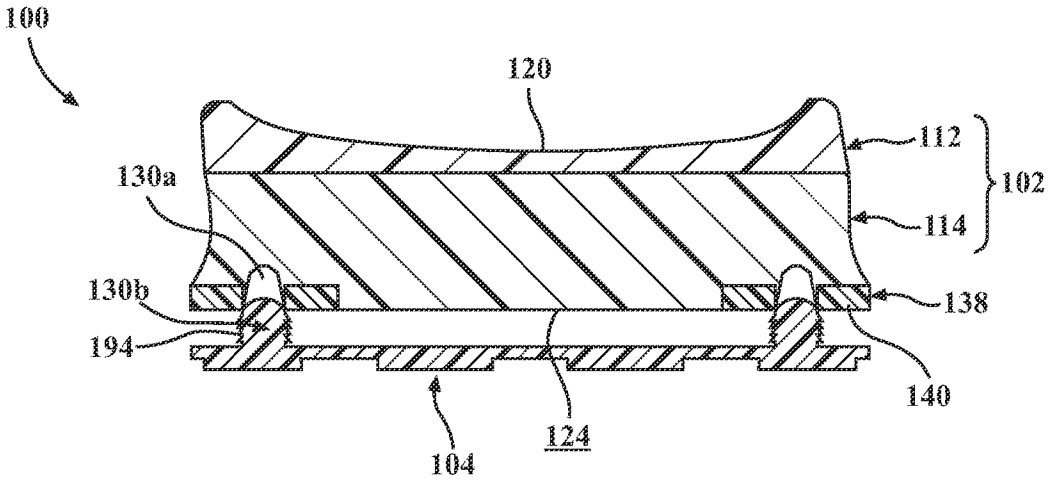
FIG. 8 is a cross-sectional view of the sole structure of FIG. 4, taken along Line 8-8 in FIG. 4.
Figure 11:
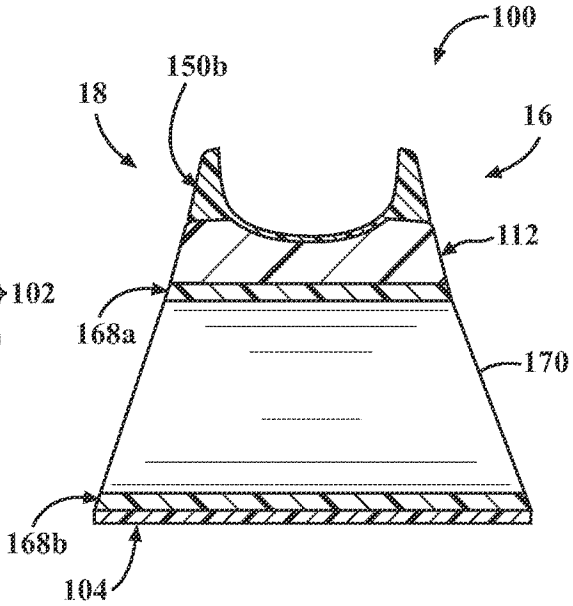
FIG. 11 is a cross-sectional view of the sole structure of FIG. 4, taken along Line 11-11 in FIG. 4.
Figure 10:
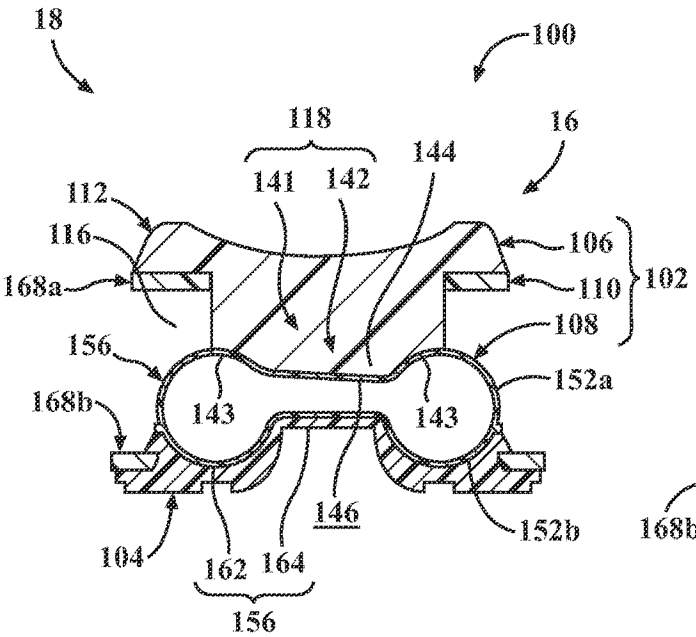
FIG. 10 is a cross-sectional view of the sole structure of FIG. 4, taken along Line 10-10 in FIG. 4.
Figure 9:
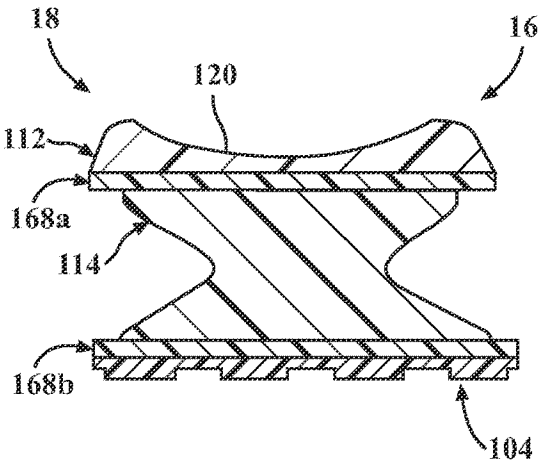
FIG. 9 is a cross-sectional view of the sole structure of FIG. 4, taken along Line 9-9 in FIG. 4.

As shown in FIGS. 7 and 10, a space formed between opposing interior surfaces of the upper and lower barrier layers 152*a*, 152*b* defines an interior void of the chamber 156. Similarly, exterior surfaces of the upper and lower barrier layers 152*a*, 152*b* define an exterior profile of the chamber 156. The chamber 156 includes a plurality of segments 162, 164 that cooperate to provide characteristics of responsiveness and support to the midsole 102. Particularly, the segments 162, 164 may be described as including a pair of cushions 162 on opposite sides of the cushioning element 108, which are connected (i.e., in fluid communication) with each other by one or more conduits 164. When assembled to in the sole structure 100, the cushions 162 of the chamber 156 are configured to be at least partially exposed along a peripheral edge of the sole structure 100.

Figure 13:
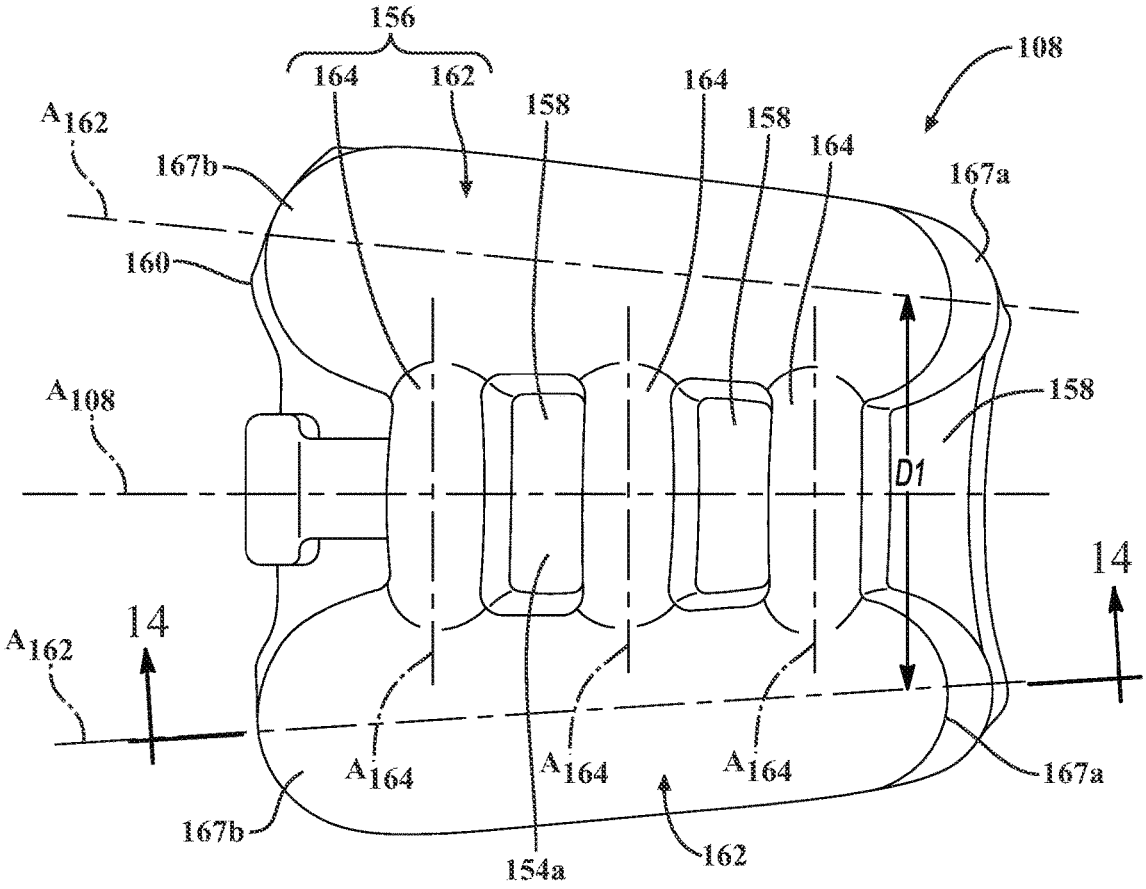
FIG. 13 is a top plan view of a cushioning element for a sole structure in accordance with the principles of the present disclosure.

Referring to FIGS. 10 and 13, each of the cushions 162 includes tubular body having a first terminal end 167*a* and a second terminal end 167*b* disposed at an opposite end of the tubular body from the first terminal end 167*a*. The cushion 162 includes a circular cross section that extends along a longitudinal axis $A_{162}$ of the cushion 162. As shown, the thickness $T_{108}$ of the bladder 108 increases continuously along the longitudinal axis $A_{162}$ from a first thickness $T_{108\text{-}1}$ at the first terminal end 167*a* to a second thickness $T_{108\text{-}2}$ at the second terminal end 167*b*. Thus, the thickness of the bladder 108 may be described as tapering along the direction from the second terminal end 167*b* to the first terminal end 167*a*.

Figure 14:
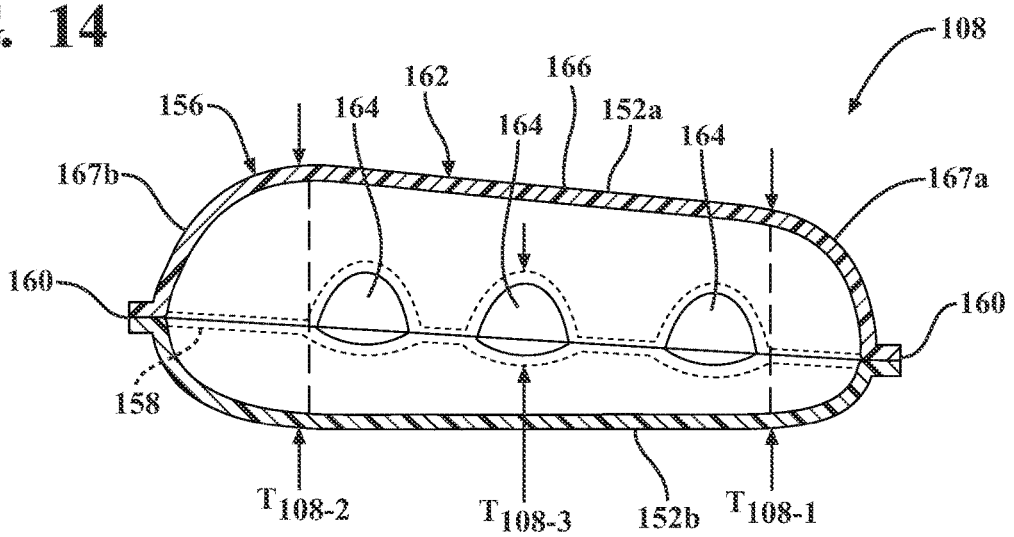
FIG. 14 is cross-sectional view of the cushioning element of FIG. 13, taken along Line 14-14 in FIG. 13.

As shown in FIG. 14, the first terminal end 167*a* and the second terminal end 167*b* of each cushion 162 are substantially dome-shaped, and each includes compound curvatures associated with the respective upper and lower barrier layers 152*a*, 152*b*. For example, the first terminal end 167*a* of each cushion 162 is formed where an end portion of the upper barrier layer 152*a* converges with and is joined to the lower barrier layer 152*b* at the peripheral seam 160 to enclose an anterior end of the tubular body 166. Referring still to FIG. 14, the second terminal end 167*b* of each cushion 162 is formed where another end portion of the upper barrier layer 152*a* converges with and is joined to the lower barrier layer 152*b* at the peripheral seam 160 to enclose the opposite end of the tubular body 166.

As provided above, each of the cushions 162 defines a respective longitudinal axis $A_{162}$ that extends from the first terminal end 167*a* to the second terminal end 167*b*. As best shown in FIG. 13, the cushions 162 are spaced apart from each other along a direction transverse to the longitudinal axes $A_{108}$ of the cushioning element 108. Accordingly, when the cushioning element 108 is assembled within the sole structure 100, the cushions 162 are spaced apart from each other along a lateral direction of the article of footwear 10 such that a first one of the cushions 162 extends along the lateral side 22 and a second one of the cushions 162 extends along the medial side 24. Furthermore, the longitudinal axes $A_{162}$ of the cushions 162 converge with each other and with the longitudinal axis $A_{10}$ of the article of footwear 10 along the direction from the posterior end 20 to the anterior end 18. Accordingly, a lateral distance D1 between the cushions 162 is greater at the second terminal ends 167*b* than at the first terminal ends 167*a*.

With continued reference to FIGS. 13 and 14, the chamber 156 further includes at least one conduit 164 extending between and fluidly coupling the cushions 162. In the illustrated example, the chamber 156 includes a plurality of the conduits 164 connecting the tubular bodies 166 of the cushions 162 to each other. The conduits 164 each extend along respective longitudinal axes $A_{164}$ that are transverse to the longitudinal axes $A_{162}$ of the cushions 162. As best shown in FIGS. 13 and 14, the conduits 164 include a first conduit 164 extending between the tubular bodies 166 of the cushions 162 adjacent to the first terminal ends 167*a*, a second conduit 164 extending between the tubular bodies 166 of the cushions 162 adjacent to the second terminal ends 167*b*, and a third conduit 164 disposed between the first conduit 164 and the second conduit 164 and connecting intermediate portions of the tubular bodies 166. Accordingly, the first conduit 164 and the second conduit 164 are disposed on opposite sides of the third conduit 164.

As best shown in FIGS. 7 and 14, the conduits 164 are defined by the cooperation of the upper barrier layer 152*a* and the lower barrier layer 152*b*. As shown in FIG. 14, the upper barrier layer 152*a* and the lower barrier layer 152*b* are formed to provide a plurality of semi-cylindrically shaped conduits 164, each having a substantially similar third thickness $T_{108\text{-}3}$ that is less than the first thickness $T_{108\text{-}1}$ and the second thickness $T_{108\text{-}2}$ of the cushions 162. A profile of each of the conduits 164 is substantially defined by the upper barrier layer 152*a*, whereby the upper barrier layer 152*a* is molded to define a curved upper portion of each conduit 164, while the lower barrier layer 152*b* is provided as a substantially flat lower portion of each of the conduits 164. Although the lower barrier layer 152*a* is initially provided in a substantially flat state, the lower barrier layer 152*b* may bulge from the web area 158 when the chamber 156 is pressurized and the lower barrier layer 152*b* is biased apart from the upper barrier layer 152*a*, as illustrated in FIG. 7.

With reference to FIGS. 7 and 13, the web area 158 is formed at a bonded region of the upper barrier layer 152*a* and the lower barrier layer 152*b*, and extends between and connects each of the segments 162, 164 of the chamber 156. Particularly, the web area 158 includes an anterior portion extending between and connecting the first terminal ends 167*a* of the respective cushions 162, and defining a first terminal edge at an anterior end of the cushioning element 108. A posterior portion of the web area 158 extends between and connects the second terminal ends 167*b* of the cushions 162, and forms a second terminal edge at a posterior end of the cushioning element 108. Intermediate portions of the web area 158 extend between and connect adjacent ones of the conduits 164 and the cushions 162. Accordingly, the intermediate portions of the web area 158 may be completely surrounded by the chamber 156. In the illustrated example, the web area 158 is disposed vertically intermediate with respect to the overall thickness $T_{108}$ of the bladder 108.

In the illustrated example, the web area 158 and the cushions 162 of the chamber 156 cooperate to define an upper pocket 154*a* on a first side of the cushioning element 108 associated with the upper barrier layer 152*a*. Here, the conduits 164 may be disposed within the upper pocket 154*a* to form an alternating series of bulges and recesses along a length of the upper pocket 154*a*. As described above, the chassis 106 may include one or more features configured to mate with the upper pocket 154*a* when the sole structure 100 is assembled. For example, the ribs 144 of the upper spine 142 are configured to be received between adjacent ones of the conduits 164 within the upper pocket 154*a*. Accordingly, sides of the ribs 144 have a profile corresponding to a shape of the conduits 164. In the illustrated example, the sides of the ribs 144 are concave and are configured to receive the convex bulges formed by the conduits 164.

As used herein, the term "barrier layer" (e.g., barrier layers 152*a*, 152*b*) encompasses both monolayer and multilayer films. In some embodiments, one or both of barrier layers 152*a*, 152*b* are each produced (e.g., thermoformed or blow molded) from a monolayer film (a single layer). In other embodiments, one or both of barrier layers 152*a*, 152*b* are each produced (e.g., thermoformed or blow molded) from a multilayer film (multiple sublayers). In either aspect, each layer or sublayer can have a film thickness ranging from about 0.2 micrometers to about be about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of barrier layers 152*a*, 152*b* can independently be transparent, translucent, and/or opaque. For example, the upper barrier layer 152*a* may be transparent, while the lower barrier layer 152*b* is opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

Barrier layers 152*a*, 152*b* can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4, 4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier layers 152*a*, 152*b* may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier layers 152*a*, 152*b* include two or more sublayers, examples of suitable multilayer films include microlayer films, such as those disclosed in Bonk et al., U.S. Pat. No. 6,582,786, which is incorporated by reference in its entirety. In further embodiments, barrier layers 152*a*, 152*b* may each independently include alternating sublayers of one or more TPU copolymer materials and one or more EVOH copolymer materials, where the total number of sublayers in each of barrier layers 152*a*, 152*b* includes at least four (4) sublayers, at least ten (10) sublayers, at least twenty (20) sublayers, at least forty (40) sublayers, and/or at least sixty (60) sublayers.

The chamber 156 can be produced from the barrier layers 152*a*, 152*b* using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, barrier layers 152*a*, 152*b* can be produced by co-extrusion followed by vacuum thermoforming to produce an inflatable chamber 156, which can optionally include one or more valves (e.g., one way valves) that allows the chamber 156 to be filled with the fluid (e.g., gas).

The chamber 156 can be provided in a fluid-filled (e.g., as provided in footwear 10) or in an unfilled state. The chamber 156 can be filled to include any suitable fluid, such as a gas or liquid. In an aspect, the gas can include air, nitrogen ($N_2$), or any other suitable gas. In other aspects, the chamber 156 can alternatively include other media, such as pellets, beads, ground recycled material, and the like (e.g., foamed beads and/or rubber beads). The fluid provided to the chamber 156 can result in the chamber 156 being pressurized. Alternatively, the fluid provided to the chamber 156 can be at atmospheric pressure such that the chamber 156 is not pressurized but, rather, simply contains a volume of fluid at atmospheric pressure.

The chamber 156 desirably has a low gas transmission rate to preserve its retained gas pressure. In some embodiments, the chamber 156 has a gas transmission rate for nitrogen gas that is at least about ten (10) times lower than a nitrogen gas transmission rate for a butyl rubber layer of substantially the same dimensions. In an aspect, the chamber 156 has a nitrogen gas transmission rate of 15 cubic-centimeter/square-meter•atmosphere•day ($cm^3/m^2$•atm•day) or less for an average film thickness of 500 micrometers (based on thicknesses of barrier layers 152*a*, 152*b*). In further aspects, the transmission rate is 10 $cm^3/m^2$•atm•day or less, 5 $cm^3/m^2$•atm•day or less, or 1 $cm^3/m^2$•atm•day or less.

In some implementations, the upper and lower barrier layers 152*a*, 152*b* are formed by respective mold portions each defining various surfaces for forming depressions and pinched surfaces corresponding to locations where the web area 158 and/or the peripheral seam 160 are formed when the upper barrier layer 152*a* and the lower barrier layer 152*b* are joined and bonded together. In some implementations, adhesive bonding joins the upper barrier layer 152*a* and the lower barrier layer 152*b* to form the web area 158 and the peripheral seam 160. In other implementations, the upper barrier layer 152*a* and the lower barrier layer 152*b* are joined to form the web area 158 and the peripheral seam 160 by thermal bonding. In some examples, one or both of the barrier layers 152*a*, 152*b* are heated to a temperature that facilitates shaping and melding. In some examples, the barrier layers 152*a*, 152*b* are heated prior to being located between their respective molds. In other examples, the mold may be heated to raise the temperature of the barrier layers 152*a*, 152*b*. In some implementations, a molding process used to form the fluid-filled chamber 156 incorporates vacuum ports within mold portions to remove air such that the upper and lower barrier layers 152*a*, 152*b* are drawn into contact with respective mold portions. In other implementations, fluids such as air may be injected into areas between the upper and lower barrier layers 152*a*, 152*b* such that pressure increases cause the barrier layers 152*a*, 152*b* to engage with surfaces of their respective mold portions.

The carriage 110 of the sole structure 100 includes a pair of frames 168*a*, 168*b* spaced apart from and connected to each other by at least one flexure 170. In the illustrated example, each of the frames 168*a*, 168*b* extends from a terminal first end 172*a*, 172*b* to a respective second end 174*a*, 174*b*. The upper frame 168*a* and the lower frame 168*b* are connected to each other at the second ends 174*a*, 174*b* by the flexure 170, while the first ends 172*a*, 172*b* of the carriage 110 are independent of each other. Accordingly, the frames 168*a*, 168*b* are able to move relative to each other by flexing or bending of the flexure 170 between the second ends 174*a*, 174*b* of the frames 168*a*, 168*b*.

Figure 6:
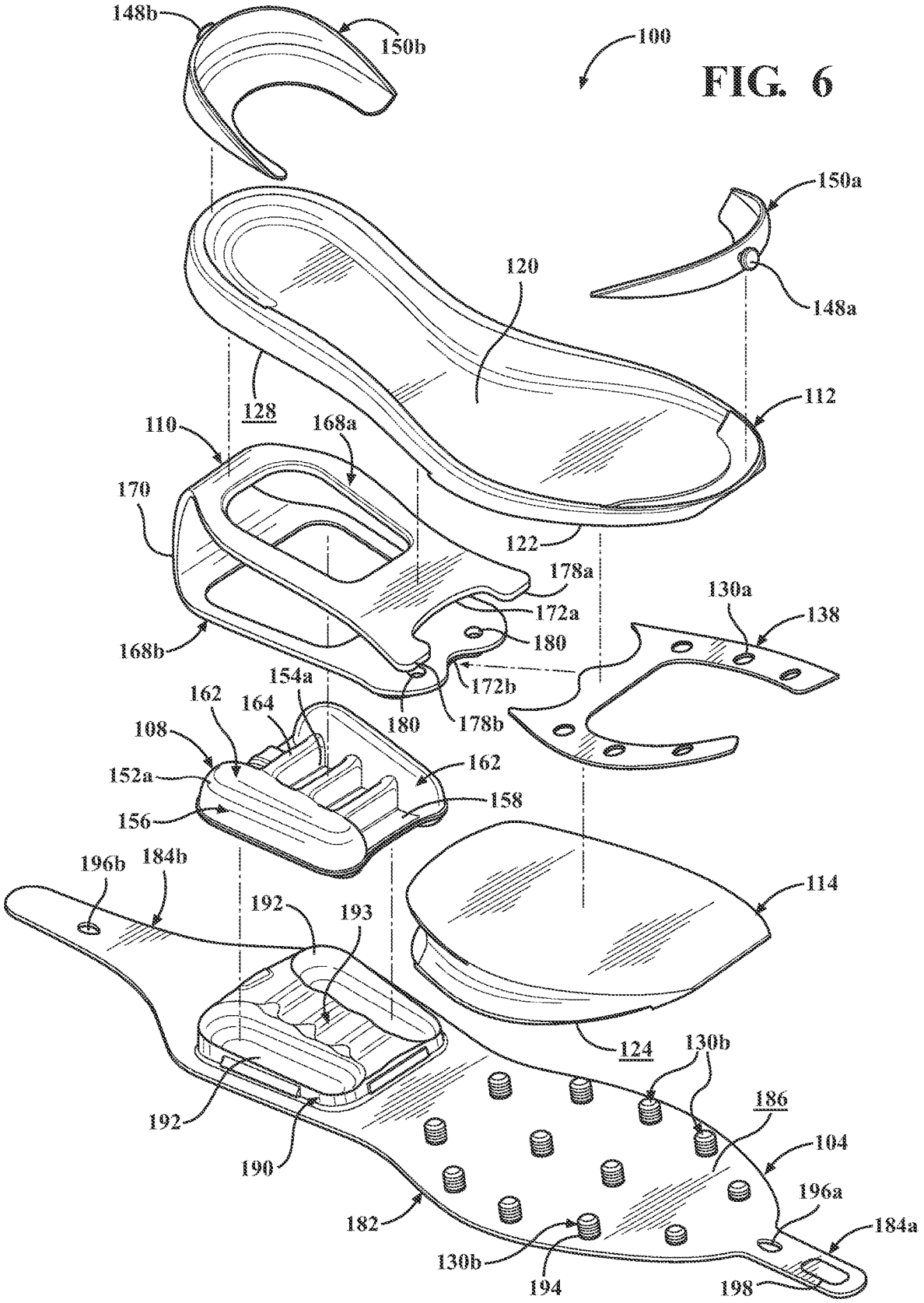
FIG. 6 is a top perspective exploded view of the sole structure of FIG. 4.

As best shown in FIGS. 5 and 6, each of the frames 168*a*, 168*b* includes an opening 176*a*, 176*b* formed through a thickness of the frame 168*a*, 168*b*. As described in greater detail below, the openings 176*a*, 176*b* are configured to receive corresponding portions of the midsole 102 and the outsole 104 to secure a position of the carriage 110 within the sole structure 100. For example, the opening 176*a* in an upper one of the frames 168*a* is configured to receive the dock 118 of the chassis 106 therein. More particularly, a peripheral profile of the upper opening 176*a* corresponds to an outer peripheral profile of abutment 141 of the dock 118 so that the dock 118 mates with the upper opening 176*a* when the sole structure 100 is assembled. Accordingly, movement of the carriage 110 in lateral (i.e., side-to-side) and longitudinal (i.e., anterior-to-posterior) directions relative to the chassis 106 is restricted by engagement of the dock 118 with the upper opening 176*a*. Likewise, as discussed below, a portion of the outsole 104 mates with the opening 176*b* of the lower frame 168*b* to fix relative lateral and longitudinal positions of the outsole 104 and carriage 110.

In addition or alternative to the openings 176*a*, 176*b*, the first ends 172*a*, 172*b* of the frames 168*a*, 168*b* may also selectively engage the chassis 106 and/or the outsole 104 to secure a position of the carriage 110. In the illustrated example, the first end 172*a* of the upper frame 168*a* is configured to be received within the slot 132 formed between the footbed 112 and the support member 114. The first end 172*a* may include a pair of lobes 178*a*, 178*b* formed on opposite sides of the upper frame 168*a*, which are inserted into corresponding portions of the slot 132 on opposite sides of the boss 123 and/or the support member 114. Accordingly, when the first end 172*a* of the upper frame 168*a* is engaged with the slot 132, an intermediate portion of the boss 123 and/or the support member 114 will be received between the lobes 178*a*, 178*b* so that the lobes 178*a*, 178*b* restrict lateral movement of the first end 172*a* of the upper frame 168*a*.

In some instances, the lobes 178*a*, 178*b* may flare or increase in width in a direction towards terminal ends of the lobes 178*a*, 178*b*. Particularly, inner edges of the lobes 178*a*, 178*b* that face or oppose each other converge with each other such that a distance between the lobes 178*a*, 178*b* decreases in a direction towards the first end 172*a*. As shown in FIG. 5, portions of the slot 132 corresponding to the lobes 178*a*, 178*b* also extend inwardly and partially around an intermediate portion of the boss 123. Accordingly, when the lobes 178*a*, 178*b* are inserted into the slot 132, the terminal ends of the lobes 178*a*, 178*b* may provide a "snap" engagement with the slot 132 such that the lobes 178*a*, 178*b* extend inwardly around the intermediate portion of the boss 123 to restrict the first end 172*a* of the upper frame 168*a* from being pulled from the slot 132.

On the lower frame 168*b*, the first end 172*b* is configured to be received and secured within the second receptacle 134 formed in the bottom surface 124 of the support member 114. As shown, the first end 172*b* includes a pair of apertures 180 configured to receive the pins 130*b* of the outsole 104 therethrough when the sole structure 100 is assembled. Accordingly, the first end 172*b* of the lower frame 168*b* is interposed between the support member 114 and the outsole 104 and a position of the first end 172*b* is fixed by cooperation of the engagement features 130*a*, 130*b*. In other examples, the first end 172*b* of the lower frame 168*b* may include one or more of the engagement features 130*a*, 130*b* for direct engagement with the support member 114.

With reference to FIG. 5, the outsole 104 includes a ground-engaging element 182 and a pair of fasteners 184*a*, 184*b* disposed at opposite ends of the ground-engaging element 182. The outsole 104 may be described as including an inner surface 186 and an outer surface 188 formed on an opposite side from the inner surface 186. Generally, the inner surface 186 is configured to face the midsole 102 and the upper 200 when the article of footwear 10 is assembled, while the outer surface 188 forms an exterior of the sole structure 200.

Figure 12:
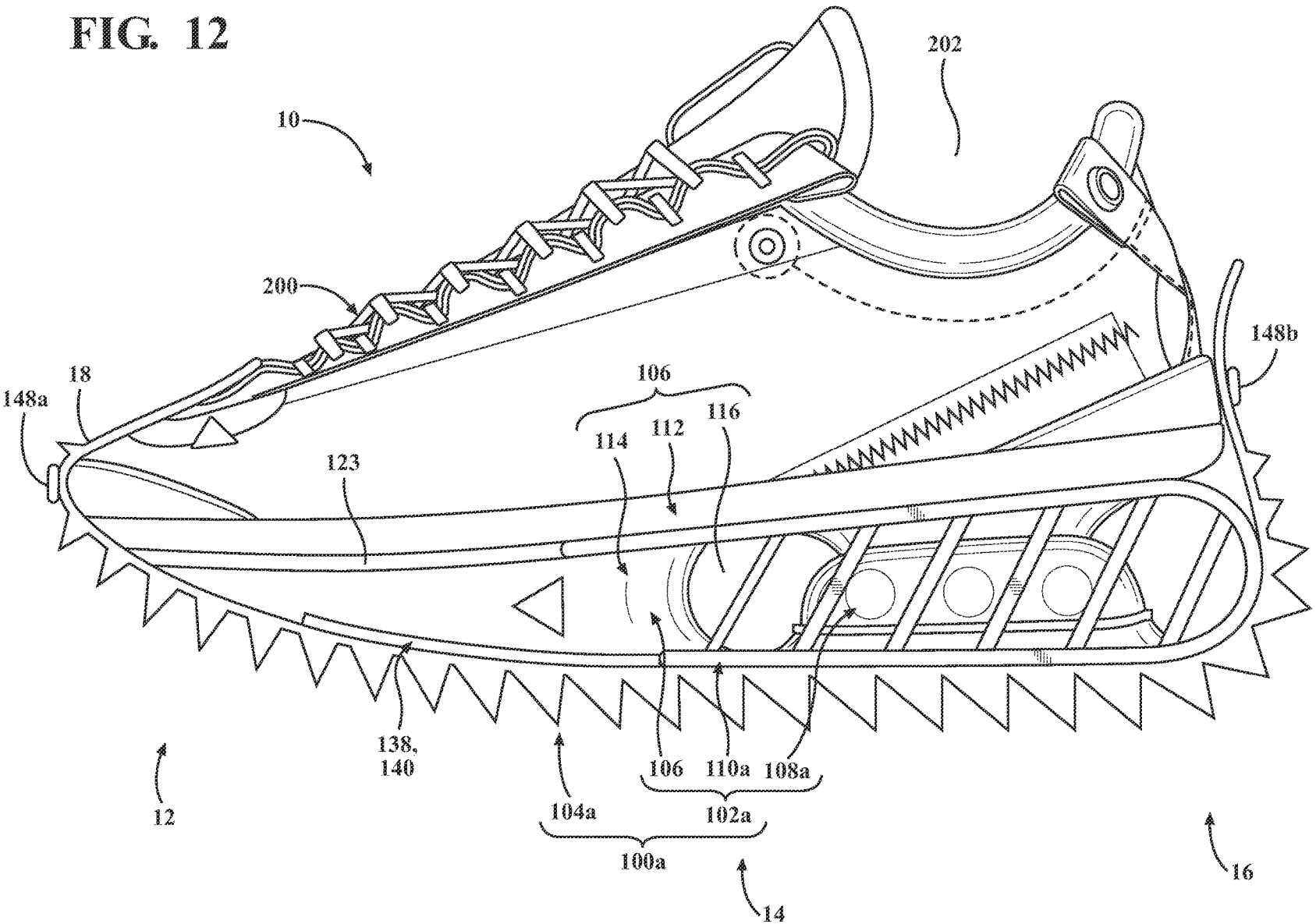
FIG. 12 is a lateral side elevation view of the article of footwear of FIG. 1, where the article of footwear includes another sole structure in accordance with the principles of the present disclosure.

The ground-engaging element 182 of the outsole 104 is configured to extend from the anterior end 18 to the posterior end 20 when the outsole 104 is attached to the sole structure 100. As discussed below, the inner surface 186 of the ground-engaging element 182 includes various features for engaging and securing the outsole 104 to the components of the midsole 102. The outer surface 188 of the ground-engaging element 182 may include one or more ground-engaging features (e.g., lugs, cleats, sipes) forming a desired tread pattern on the exterior of the sole structure 100. Because the outsole 104 is interchangeable, different versions of the outsole 104 may be provided with different tread patterns depending on an intended use of the shoe. For example, an outsole 104 with a first tread pattern (FIG. 1) may be provided for use on solid or hard surfaces (e.g., wood, concrete) and an outsole 104*a* with a second tread pattern (FIG. 12) may be provided for use on loose or soft surfaces (e.g., dirt, grass).

As shown in FIG. 6, the outsole 104 includes a cradle 190 disposed on the inner surface 186 of the ground-engaging element 182 in the heel region 16. The cradle 190 is configured to receive the lower portion 152*b* of the bladder 108 therein when the sole structure 100 is assembled. Accordingly, the cradle 190 of the outsole 104 and the dock 118 of the chassis 106 cooperate to removably secure the bladder 108 within the sole structure 100. As shown, the cradle 190 includes a pair of lower channels 192 each configured to receive one of the cushions 162 therein. The cradle 190 may also include a lower spine 193 disposed between the channels 192 and configured to be received within the lower pocket 154*b* of the bladder 108 when the sole structure 100 is assembled. In the illustrated example, the cradle 190 is integrally formed as a part of the ground-engaging element 182 of the outsole 104. However, in other examples, the cradle 190 may be formed separately form the ground-engaging element 182 and/or include a different material than the ground-engaging element 182.

As set forth above, the ground-engaging element 182 of the outsole 104 also includes a plurality of the engagement features 130*a*, 130*b* configured to selectively engage corresponding engagement features 130*a*, 130*b* formed in the support member 114 of the chassis 106. In the illustrated example, the ground-engaging element 182 includes a plurality of pins 130*b* extending from the inner surface 186 in a portion of the ground-engaging element 182 configured to be disposed within the forefoot region 12. Optionally, the pins 130*b* may include a plurality of annular ribs or barbs 194 arranged in series along a length of the each pin 130*b*. The ribs or barbs 194 are configured to restrict disengagement of the pins 130*b* from the apertures 130*a* formed in the bottom surface 124 of the support member 114.

As provided above, the outsole 104 includes a pair of the fasteners 184*a*, 184*b* extending from opposite ends of the ground-engaging element 182. In the illustrated example, each of the fasteners 184*a*, 184*b* includes a tab 184*a*, 184*b* projecting from an end of the ground-engaging element 182, where the tabs 184*a*, 184*b* and the ground-engaging element 182 are integrally formed with each other. Generally, each of the tabs 184*a*, 184*b* is configured to be selectively secured to a respective one of the attachment points 148*a*, 148*b* of the chassis 106. In the illustrated example, where the attachment points 148*a*, 148*b* are embodied as pins 148*a*, 148*b*, the tabs 184*a*, 184*b* include corresponding sockets or apertures 196*a*, 196*b* configured to interface with the pins 148*a*, 148*b* to secure the outsole 104 to the chassis 106. Specifically, the heads of the pins 148*a*, 148*b* are pressed through the apertures 196*a*, 196*b* to attach the tabs 184*a*, 184*b* to each of the clips 150*a*, 150*b* of the chassis 106.

Optionally, one or both of the tabs 184*a*, 184*b* may include a retainer 198 configured to maintain the tabs 184*a*, 184*b* against the upper 200 when the sole structure 100 is assembled. For example, one or both of the tabs 184*a*, 184*b* may include a fastener, such as a snap or hook-and-loop fabric, configured to attach to a corresponding fastener on the upper 200 to secure the tab 184*a*, 184*b* against the upper 200.

The upper 200 is attached to the sole structure 100 and includes interior surfaces that define an interior void 202 configured to receive and secure a foot for support on the sole structure 100. The upper 200 may be formed from one or more materials that are stitched or adhesively bonded together to form the interior void. Suitable materials of the upper may include, but are not limited to, mesh, textiles, foam, leather, and synthetic leather. The materials may be selected and located to impart properties of durability, air-permeability, wear-resistance, flexibility, and comfort.

As set forth above, the article of footwear 10, and particularly the sole structure 100 of the present disclosure, is configured as a modular structure, whereby components of the sole structure 100 are removably attached to each other such that one or more of the components can be easily interchanged with a corresponding component having different properties. For example, one or more of the outsole 104, the bladder 108, or the carriage 110 (FIG. 1) may be detached from the chassis 106 and replaced with an alternative outsole 104*a*, bladder 108*a*, or carriage 110*a* (FIG. 12) having different properties.

In use, the sole structure 100 is assembled by initially engaging the bladder 108 and the carriage 110 with the chassis 106, as described above. Namely, the first end 172*a* of the upper frame 168*a* of the carriage 110 is inserted into the slot 132 and the upper frame 168*a* is positioned against the recessed surface 128 so that the dock 118 is received through the opening 176*a* of the upper frame 168*a*. At the same time, the first end 172*b* of the lower frame 168*b* is positioned within the notch 134 in the support member 114.

With the carriage 110 attached to the chassis 106, the bladder 108 can be engaged with the dock 118 by inserting the bladder 108 through the opening 176*b* formed in the lower frame 168*b* of the carriage. Here, the upper pocket 154*a* formed by the upper portion 152*a* of the bladder 108 is engaged with the dock 118 of the chassis 106 such that the ribs 144 are received between the conduits 164 of the bladder 108 and the cushions 162 are received within the channels 143. Here, the engagement of the channels 143 and the cushions 162 secures a lateral position of the bladder 108 while engagement of the ribs 144 and conduits 164 secures a longitudinal position of the bladder 108.

With the bladder 108 engaged with the dock 118, the outsole 104 is attached to the midsole 102 to secure the bladder 108 and the carriage 110 within the recess 116. Here, the first fastener 184*a* is attached at the anterior end 18 by inserting the first pin 148*a* through the aperture 196*a* of the first fastener 184*a*. The outsole 104 is secured to the support member 114 by inserting the barbed pins 130*b* formed on the inner surface 186 of the outsole 104 within the apertures 130*a* formed in the bottom surface 124 of the support member 114. In the heel region 16, the cradle 190 disposed on the inner surface 186 of the outsole 104 is engaged with the lower portion 152*b* of the bladder 108 such that the lower spine 193 is received within the lower pocket 154*b* and the cushions 162 are received within the channels 192. The outsole 104 is secured at the posterior end 20 by inserting the second pin 148*b* through the aperture 196*b* formed in the second fastener 184*b*.

In use, the outsole 104 may be detached by pulling either of the fasteners 184*a*, 184*b* to disengage the fasteners 184*a*, 184*b* from the pins 148*a*, 148*b*. Any one of the outsole 104, the cushioning element 108, and/or the carriage 110 can then be replaced with a different outsole 104*a*, cushioning element 108*a*, and/or carriage 110*a* to modify properties of the sole structure 100.

With particular reference to FIGS. 15-24, an article of footwear 10*a* is provided and includes a sole structure 100*a* and the upper 200 attached to the sole structure 100*a*. In view of the substantial similarity in structure and function of the components associated with the article of footwear 10 with respect to the article of footwear 10*a*, like reference numerals are used hereinafter and in the drawings to identify like components while like reference numerals containing letter extensions are used to identify those components that have been modified.

The sole structure 100*a* includes a midsole 102*a* configured to provide cushioning characteristics to the sole structure 100*a*, and an outsole 104*a* configured to provide a ground-engaging surface of the article of footwear 10*a*. Unlike conventional sole structures, the midsole 102*a* of the sole structure 100*a* may be formed compositely and include a plurality of subcomponents for providing desired forms of cushioning and support throughout the sole structure 100*a*. For example, the midsole 102*a* may be described as including a chassis 106*a* and the cushioning element 108, where the chassis 106*a* is configured to provide an interface for removably attaching the cushioning element 108 to the article of footwear 10*a*. The sole structure 100*a*, and more particularly, the midsole 102*a*, may further include an interchangeable carriage 110*a* configured to be inserted between the chassis 106*a* and the outsole 104*a* in the heel region 16. Additionally, the components of the sole structure 100*a* are provided in a modular configuration, wherein each of the outsole 104*a*, the cushioning element 108, and the carriage 110*a* is selectively attachable to the chassis 106*a* so that the sole structure 100*a* can be reconfigured by a user.

Figure 15:
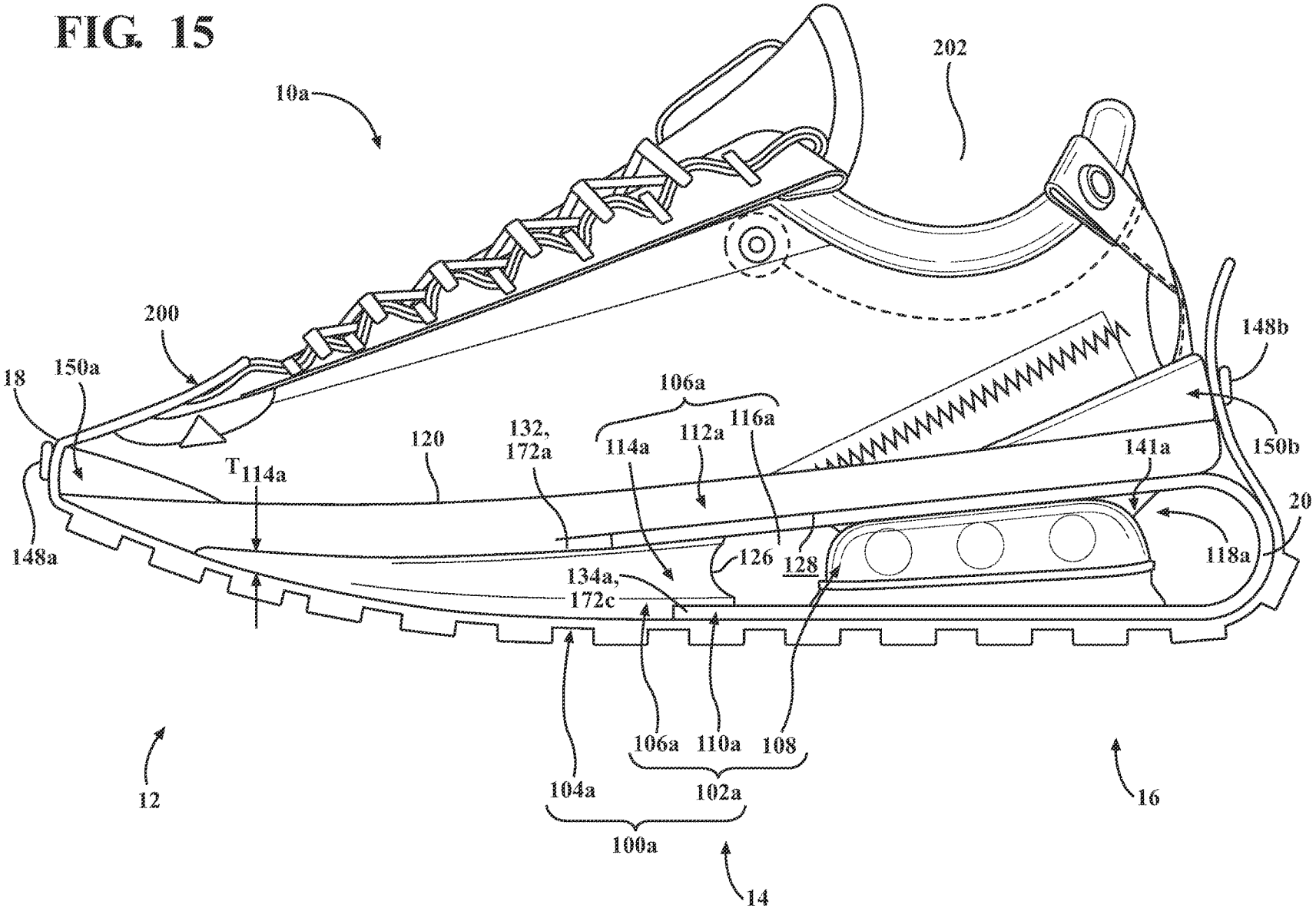
FIG. 15 is a lateral side elevation view of an article of footwear including a sole structure in accordance with principles of the present disclosure.
Figure 16:
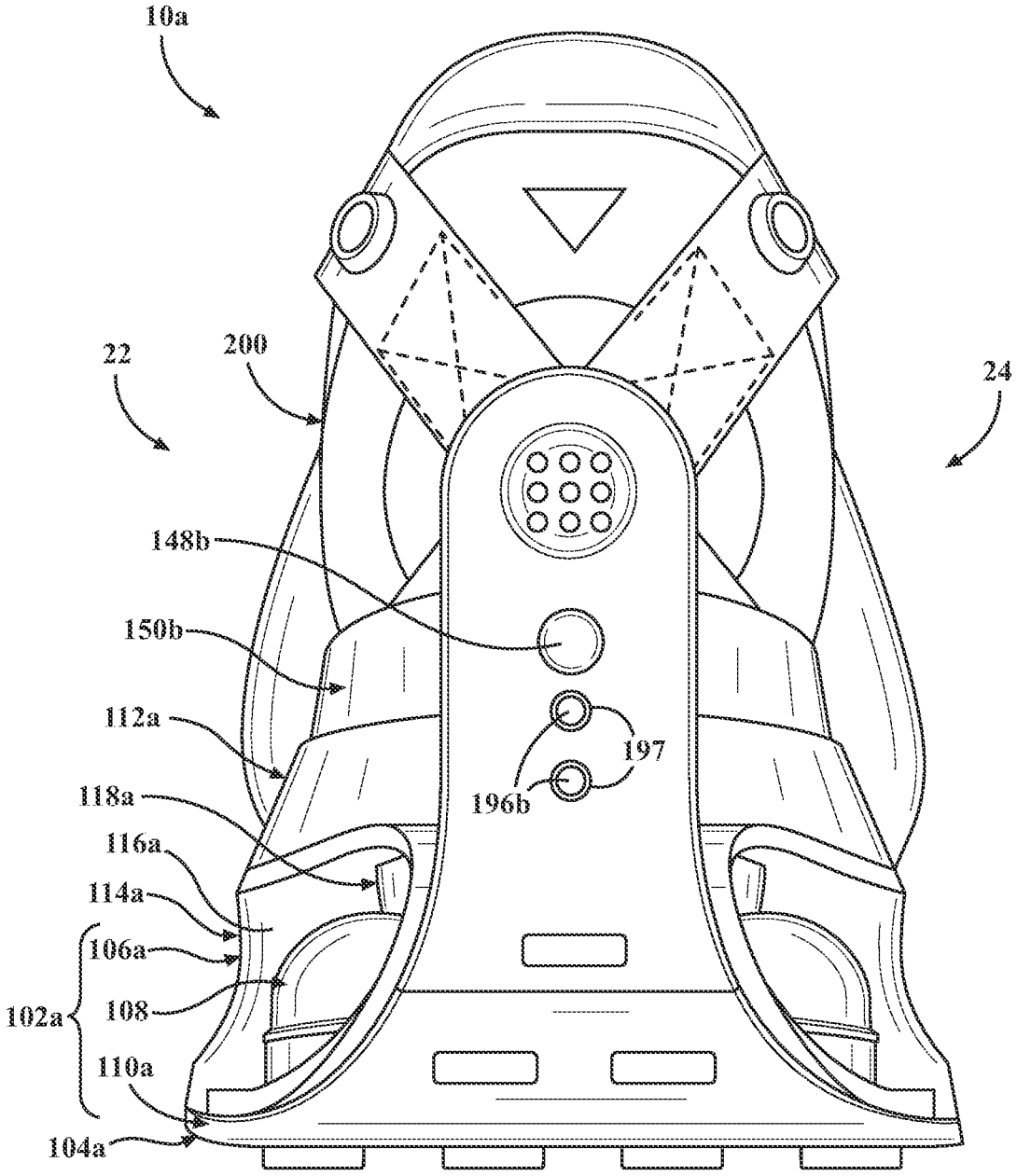
FIG. 16 is a posterior elevation view of the article of footwear of FIG. 15.
Figure 17:
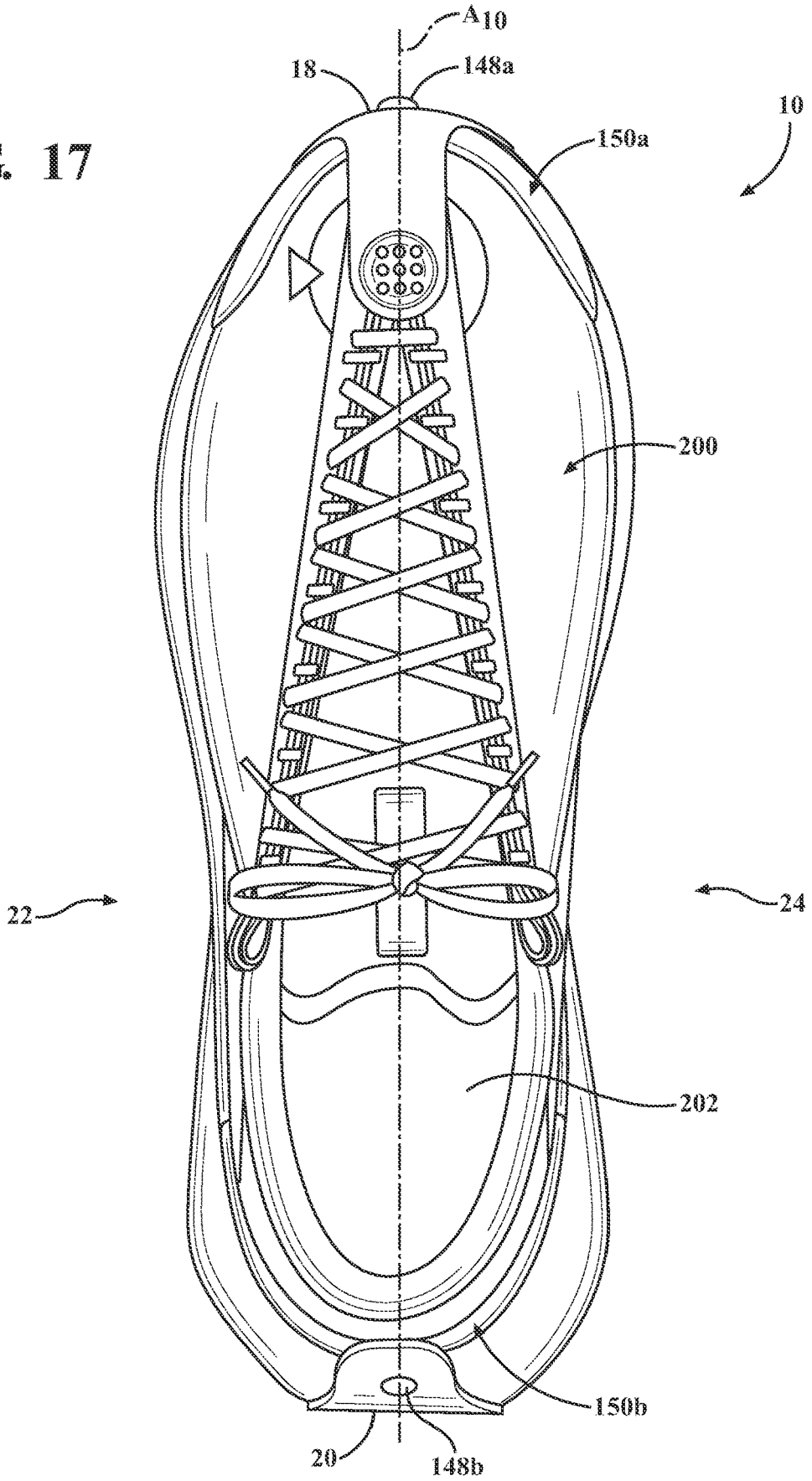
FIG. 17 is a top plan view of the article of footwear of FIG. 15.
Figure 18:
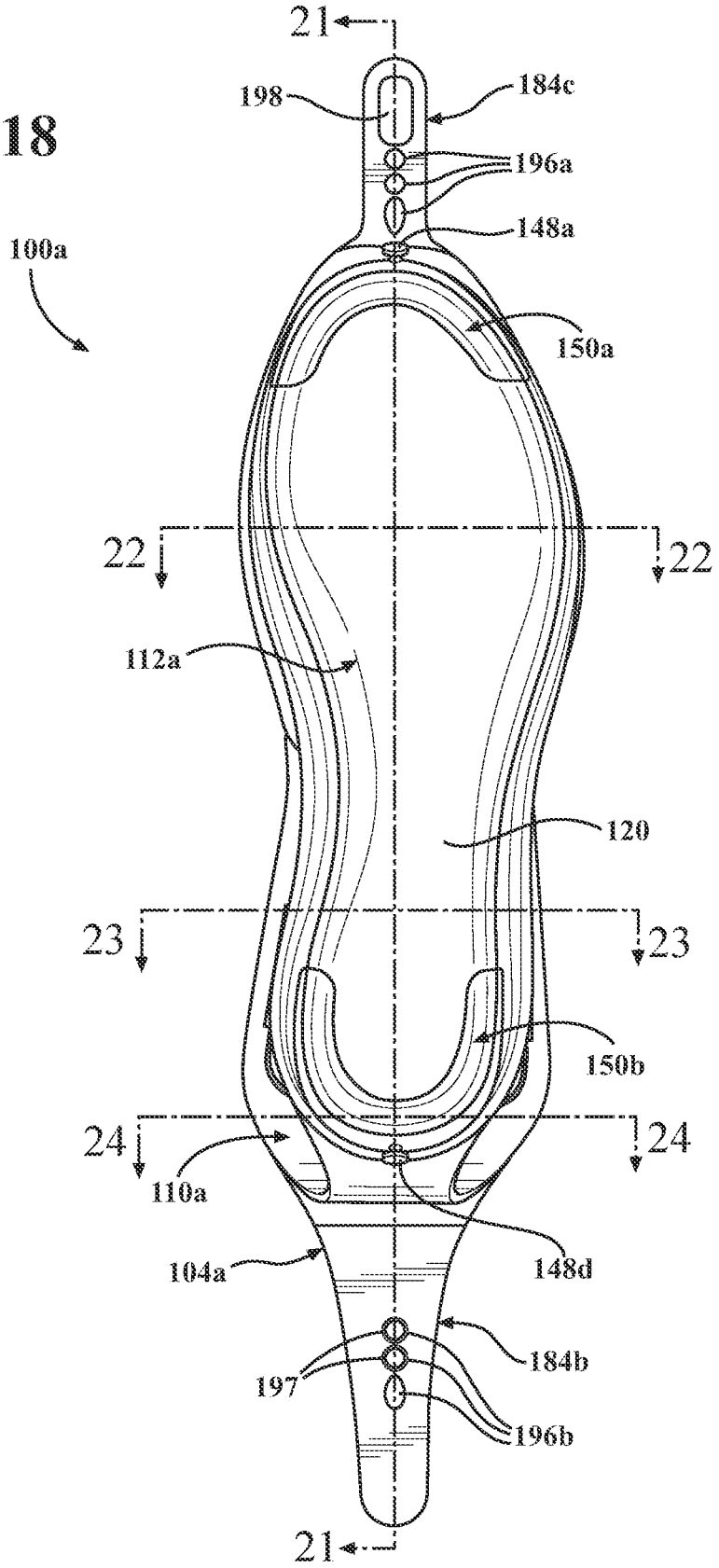
FIG. 18 is a top plan view of a sole structure of an article of footwear in accordance with the principles of the present disclosure.

With reference to FIG. 15, the chassis 106*a* of the midsole 102*a* extends continuously from the anterior end 18 to the posterior end 20. An upper portion of the chassis 106*a* includes a footbed 112*a* configured to attach to the upper 200 and to provide support and cushioning for a plantar surface of the foot. A lower portion of the chassis 106*a* includes a support member 114*a* formed in the forefoot region 12 and the mid-foot region 14, and a recess 116*a* extending through the mid-foot region 14 and the heel region 16. As discussed below, the support member 114*a* is configured to provide cushioning along the forefoot region 12, while the recess 116*a* is configured to receive the bladder 108 and the carriage 110*a* for supporting the heel region 16 of the upper 200. The chassis 106*a* also includes a dock 118*a* protruding from the footbed 112*a* within the recess 116*a*. The dock 118*a* is configured to interface with the bladder 108 to removably secure a position of the bladder 108 within the recess 116*a* when the sole structure 100*a* is assembled.

The footbed 112*a* extends continuously from the anterior end 18 to the posterior end 20 and defines a top side 120 of the chassis 106*a* configured to face the upper 200 when the article of footwear 10*a* is assembled. The footbed 112*a* also includes a bottom side 122*a* formed on an opposite side from the top side 120, where a distance between the top side 120 and the bottom side 122*a* forms a thickness of the footbed 112*a*. The footbed 112*a* may include one or more resilient polymeric materials for providing cushioning and support along the plantar surface of the foot, as discussed above with respect to the footbed 112.

Figure 19:
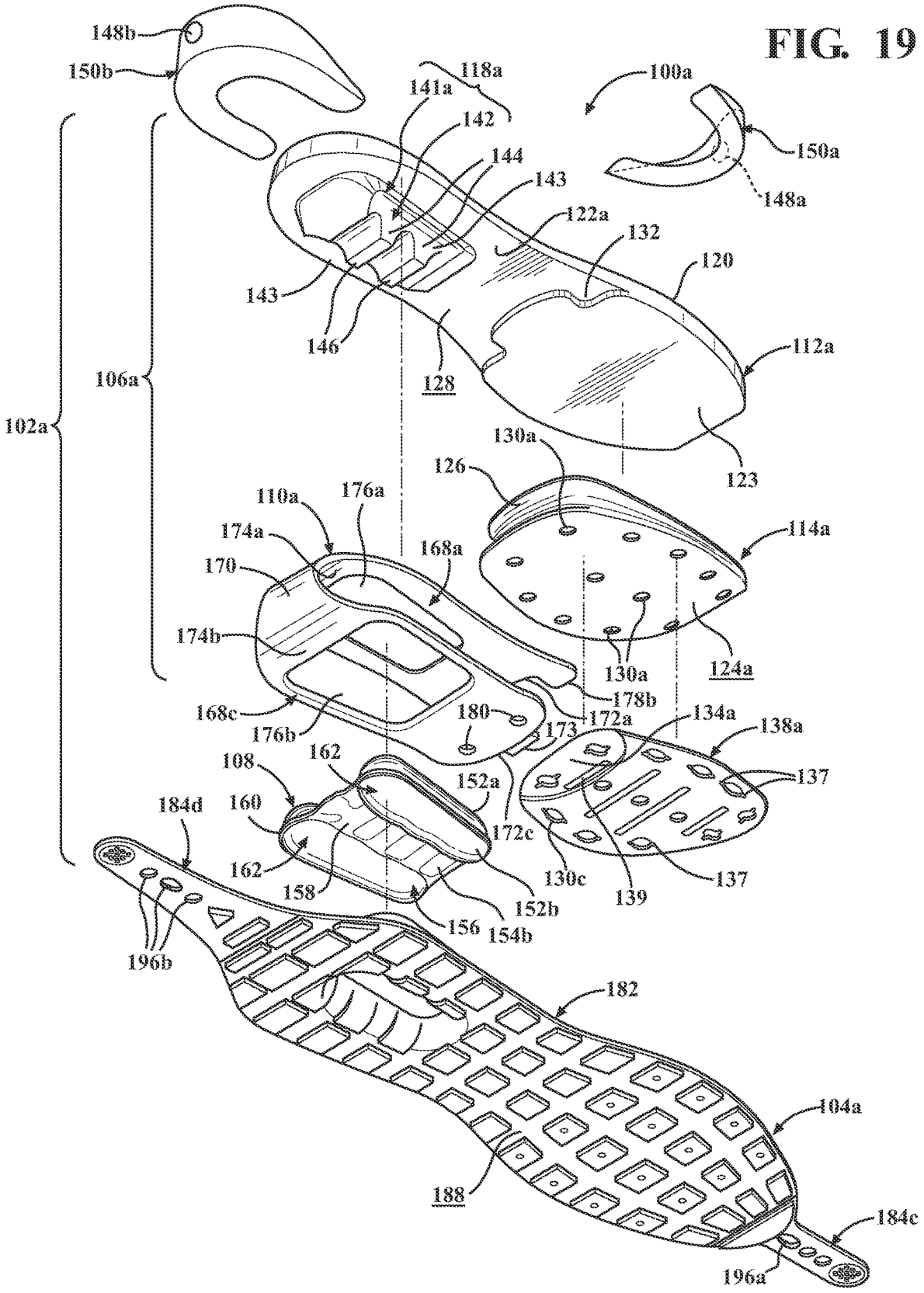
FIG. 19 is a bottom perspective exploded view of the sole structure of FIG. 18.

As shown, the support member 114*a* depends from the bottom side 122*a* of the footbed 112*a* and defines a bottom surface 124*a* of the chassis 106*a*. Here, the support member 114*a* extends continuously from the anterior end 18 to an end wall 126 formed in the mid-foot region 14. A thickness $T_{114a}$ of the support member 114*a* progressively increases along a direction from the anterior end 18 to the end wall 126. As shown in FIG. 19, the bottom surface 124*a* of the support member 114*a* may include one or more of the apertures 130*a* configured to cooperate with corresponding pins 130*d* of the outsole 104*a* to secure a relative position of the outsole 104*a* with respect to the chassis 106*a* in the forefoot region 12.

The recess 116*a* is defined by a recessed surface 128 that is offset from the bottom surface 124*a* and extends continuously from the end wall 126 through the posterior end 20. In the illustrated example, the recessed surface 128 is defined by the bottom side 122*a* of the footbed 112*a*. However, in other examples, the recessed surface 128 may be spaced apart from the bottom side of the footbed 112*a*.

In the illustrated example, the support member 114*a* is shown as a separate component attached to the footbed 112*a* on the bottom side 122*a*. Accordingly, the support member 114*a* may include different materials than the footbed 112*a* for providing different cushioning and performance characteristics on a lower portion of the chassis 106*a*. For instance, the footbed 112*a* may include a material having a different durometer to provide a greater degree of cushioning along the plantar surface of the foot. In other examples, the footbed 112*a* and the support member 114*a* may be formed of the same material and/or may be integrally formed as a single piece.

The chassis 106*a* further includes the first receptacle 132 for engaging an upper portion of the carriage 110*a* and a second receptacle 134*a* for engaging a lower portion of the carriage 110*a*. The first receptacle 132 includes a slot 132 extending between the footbed 112*a* and the support member 114*a* at the end wall 126. In the illustrated example, the slot 132 is formed along the bottom side 122*a* of the footbed 112*a*. Particularly, the footbed 112*a* may include the boss 123 protruding from the bottom side 122*a*. When the chassis 106*a* is assembled, the support member 114*a* attaches to the boss 123 such that the slot 132 is formed between the bottom side 122*a* and the support member 114*a*. Alternatively, the slot 132 may be formed through the end wall 126 of the support member 114*a* adjacent to the bottom side 122*a* of the footbed 112*a*. In the illustrated example, the end wall 126 has a convex profile from the lateral side 22 to the medial side 24. The slot 132 extends along a convex path from the lateral side 22 to the medial side 24 and is configured to receive a corresponding concave end of the upper portion of the carriage 110*a*.

The sole structure 100*a* may include a plate or brace 138*a* disposed between the bottom surface 124*a* of the support member 114*a* and the outsole 104*a*. Unlike the brace 138 described above, which is embedded along a periphery of the support member 114, the brace 138*a* of the current example is formed as a plate 138*a* disposed adjacent to and covering the bottom surface 124*a* of the support member 114*a*. As shown, the brace 138*a* includes a plurality of secondary engagement features 130*c* configured to receive and secure the pins 130*d* formed on the outsole 104. The engagement features 130*c* of the plate 138 may include one or more reliefs 137 extending radially outwardly from the perimeter of the aperture 130*c*. In the illustrated example, each engagement feature 130*c* includes a pair of reliefs 137 extending from opposite sides of the aperture 130*c* such that the reliefs 137 are diametrically opposed to one another. During assembly of the sole structure 100*a*, the reliefs 137 may accommodate deformation of the resilient pins 130*d* of the outsole 104*a* as the pins 130*d* are pressed through the apertures 130*c* of the plate 138*a* and into the apertures 130*a* of the support member 114.

With continued reference to FIG. 19, in the present example, the second receptacle 134*a* is formed in the plate 138*a* instead of the support member 114*a*. Thus, as shown in FIG. 19, the plate 138*a* includes a notch 134*a* configured to receive a terminal end 172*c* of the carriage 110*a*. Here, the notch 134*a* may include one or more of the apertures 130*c* configured to receive corresponding pins 130*d* of the outsole 104*a* through the carriage 110*a*. For instance, the pins 130*d* of the outsole 104*a* may extend through the carriage 110*a* and into the apertures 130*c* formed in the notch 134*a*.

Figure 21:
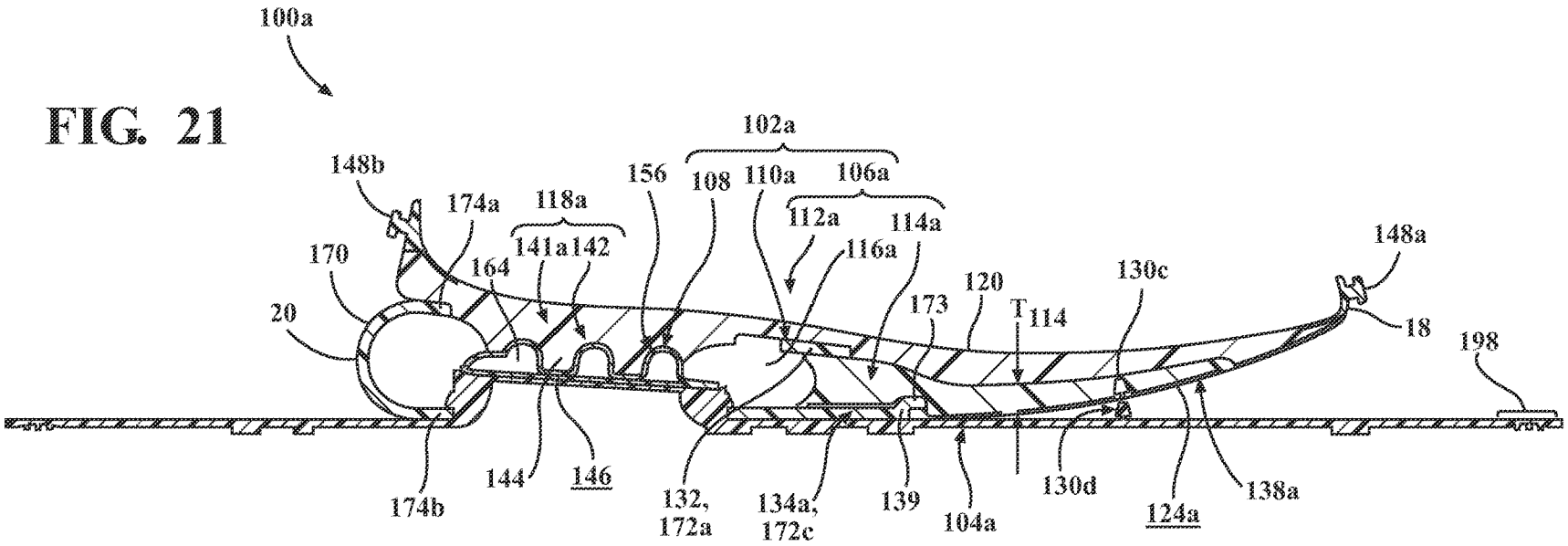
FIG. 21 is a cross-sectional view of the sole structure of FIG. 18, taken along Line 21-21 in FIG. 18.

In addition to the apertures 130*c*, the plate 138*a* may also include an elongate slot 139 formed through a thickness of the plate 138*a*. As discussed in greater detail below, the slot 139 is configured to receive a tab or lip 173 that extends from the lower first end 172*c* of the carriage 110*a*. Thus, when the sole structure 100*a* is assembled, the lower portion of the carriage 110*a* is received within the notch 134*a* of the plate 138*a* between the chassis 106*a* and the outsole 104*a*, and a position of the lower portion of the carriage 110*a* is fixed relative to the chassis 106*a* by the engagement features 130*a*, 130*c*, 130*d* and the interface between the slot 139 and the lip 173 (FIG. 21).

In the heel region 16, the chassis 106*a* includes the dock 118*a* extending into the recess 116*a* from the recessed surface 128 (i.e., the bottom side 122*a* of the footbed 112*a*). The dock 118*a* is configured substantially similar to the dock 118 described previously with respect to the article of footwear 10. However, the dock 118*a* of the present example has an abutment 141*a* including a reduced height, such that the dock 118*a* protrudes from the recessed surface 128 less than the dock 118*a*. The chassis 106*a* further includes the pair of the fixtures or attachment points 148*a*, 148*b* disposed at opposite ends of the chassis 106*a*. As previously described, the attachment points 148*a*, 148*b* are each formed as part of a respective clip 150*a*, 150*b* attached to the top side 120 of the footbed 112*a*.

The carriage 110*a* of the sole structure 100*a* includes the upper frame 168*a* and a lower frame 168*b* spaced apart from and connected to each other by at least one flexure 170. In the illustrated example, each of the frames 168*a*, 168*c* extends from a terminal first end 172*a*, 172*c* to a respective second end 174*a*, 174*b*. The upper frame 168*a* and the lower frame 168*c* are connected to each other at the second ends 174*a*, 174*b* by the flexure 170, while the first ends 172*a*, 172*c* of the carriage 110*a* are independent of each other. Accordingly, the frames 168*a*, 168*c* are able to move relative to each other by flexing or bending of the flexure 170 between the second ends 174*a*, 174*b* of the frames 168*a*, 168*c*.

Figure 20:
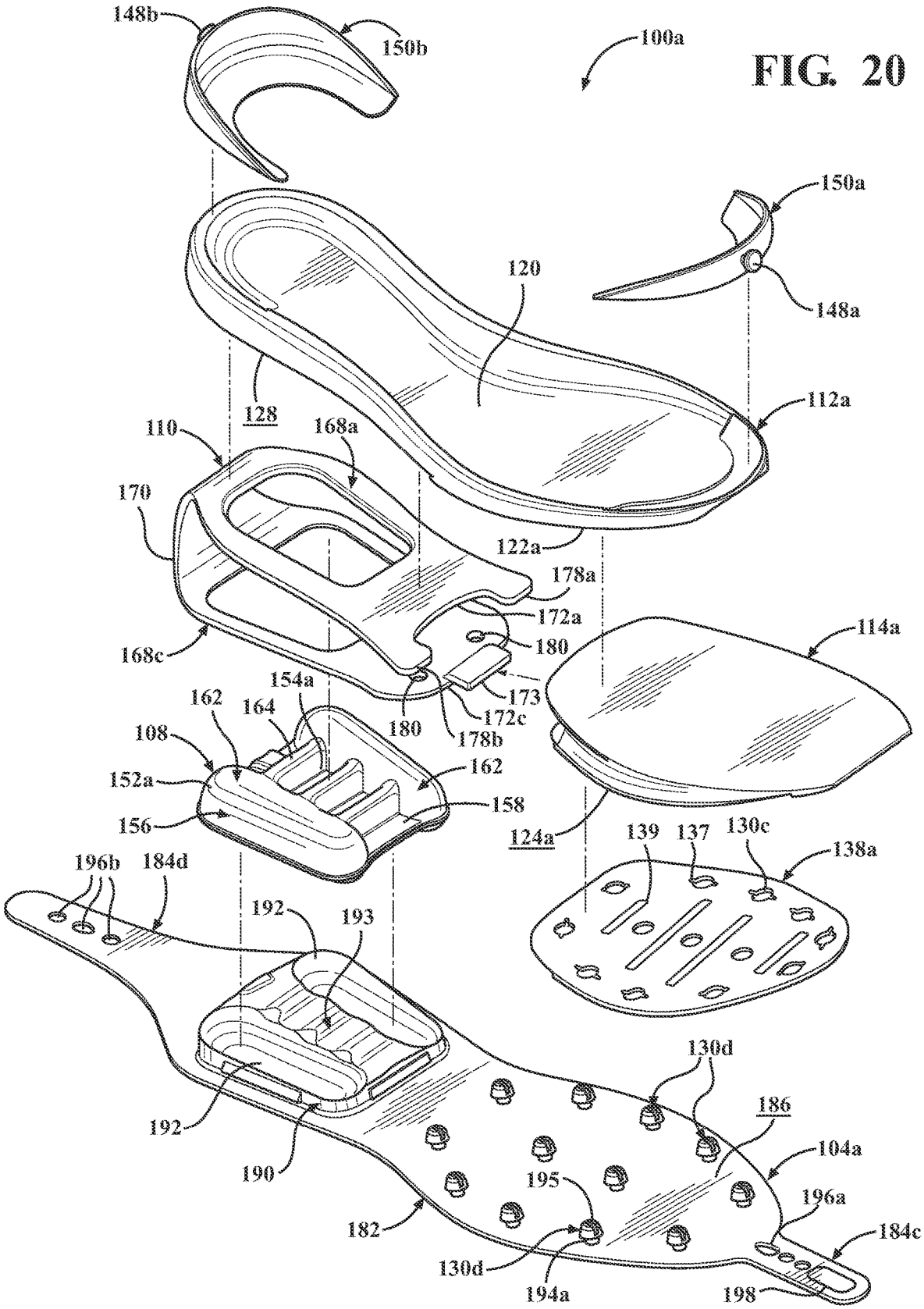
FIG. 20 is a top perspective exploded view of the sole structure of FIG. 18.

As best shown in FIGS. 19 and 20, each of the frames 168*a*, 168*c* includes an opening 176*a*, 176*b* formed through a thickness of the frame 168*a*, 168*c*. As described in greater detail below, the openings 176*a*, 176*b* are configured to receive corresponding portions of the midsole 102*a* and the outsole 104*a* to secure a position of the carriage 110*a* within the sole structure 100*a*. For example, the opening 176*a* in an upper one of the frames 168*a* is configured to receive the dock 118*a* of the chassis 106*a* therein. More particularly, a peripheral profile of the upper opening 176*a* corresponds to an outer peripheral profile of the abutment 141*a* of the dock 118*a* so that the dock 118*a* mates with the upper opening 176*a* when the sole structure 100*a* is assembled. Accordingly, movement of the carriage 110*a* in lateral (i.e., side-to-side) and longitudinal (i.e., anterior-to-posterior) directions relative to the chassis 106*a* is restricted by engagement of the dock 118*a* with the upper opening 176*a*. Likewise, as discussed below, a portion of the outsole 104*a* mates with the opening 176*b* of the lower frame 168*c* to fix relative lateral and longitudinal positions of the outsole 104*a* and carriage 110*a*.

In addition or alternative to the openings 176*a*, 176*b*, the first ends 172*a*, 172*c* of the frames 168*a*, 168*c* may also selectively engage the chassis 106*a* and/or the outsole 104*a* to secure a position of the carriage 110*a*. In the illustrated example, the first end 172*a* of the upper frame 168*a* is configured to be received within the slot 132, as previously discussed. On the lower frame 168*c*, the first end 172*c* is configured to be received and secured within the second receptacle 134*a* formed in the plate 138*a*. As shown, the first end 172*c* includes a pair of apertures 180 configured to receive the pins 130*d* of the outsole 104*a* therethrough when the sole structure 100*a* is assembled. Additionally, the first end 172*c* of the lower plate 168*c* includes an elongate lip 173 projecting from an upper edge of the first end 172*c*. The elongate lip 173 is configured to be inserted through the slot 139 formed through the plate 138*a* within the notch 134*a*. When the sole structure 100*a* is assembled, the lip 173 is inserted through the slot 139 and is received between the plate 138*a* and the bottom surface 124*a* of the support member 114*a*.

With reference to FIG. 20, the outsole 104*a* includes a ground-engaging element 182 and a pair of fasteners 184*c*, 184*d* disposed at opposite ends of the ground-engaging element 182. The outsole 104*a* may be described as including an inner surface 186 and an outer surface 188 formed on an opposite side from the inner surface 186. Generally, the inner surface 186 is configured to face the midsole 102*a* and the upper 200 when the article of footwear 10*a* is assembled, while the outer surface 188 forms an exterior of the sole structure 100.

The ground-engaging element 182 of the outsole 104*a* is configured to extend from the anterior end 18 to the posterior end 20 when the outsole 104*a* is attached to the sole structure 100*a*. As discussed below, the inner surface 186 of the ground-engaging element 182 includes various features for engaging and securing the outsole 104*a* to the components of the midsole 102*a*. The outer surface 188 of the ground-engaging element 182 may include one or more ground-engaging features (e.g., lugs, cleats, sipes) forming a desired tread pattern on the exterior of the sole structure 100*a*. Because the outsole 104*a* is interchangeable, different versions of the outsole 104*a* may be provided with different tread patterns depending on an intended use of the footwear.

As shown in FIG. 20, the outsole 104*a* includes the cradle 190 disposed on the inner surface 186 of the ground-engaging element 182 in the heel region 16. The cradle 190 is configured to receive the lower portion 152*b* of the bladder 108 therein when the sole structure 100*a* is assembled. Accordingly, the cradle 190 of the outsole 104*a* and the dock 118*a* of the chassis 106*a* cooperate to removably secure the bladder 108 within the sole structure 100*a*. As shown, the cradle 190 includes the lower channels 192 each configured to receive one of the cushions 162 therein. The cradle 190 may also include the lower spine 193 disposed between the channels 192 and configured to be received within the lower pocket 154*b* of the bladder 108 when the sole structure 100*a* is assembled. In the illustrated example, the cradle 190 is integrally formed as a part of the ground-engaging element 182 of the outsole 104*a*. However, in other examples, the cradle 190 may be formed separately form the ground-engaging element 182 and/or include a different material than the ground-engaging element 182.

As set forth above, the ground-engaging element 182 of the outsole 104*a* also includes a plurality of the engagement features 130*d* configured to selectively engage corresponding engagement features 130*a*, 130*c* formed in the support member 114*a* and the plate 138*a*. In the illustrated example, the ground-engaging element 182 includes a plurality of pins 130*d* extending from the inner surface 186 in a portion of the ground-engaging element 182 configured to be disposed within the forefoot region 12.

Figure 22B:
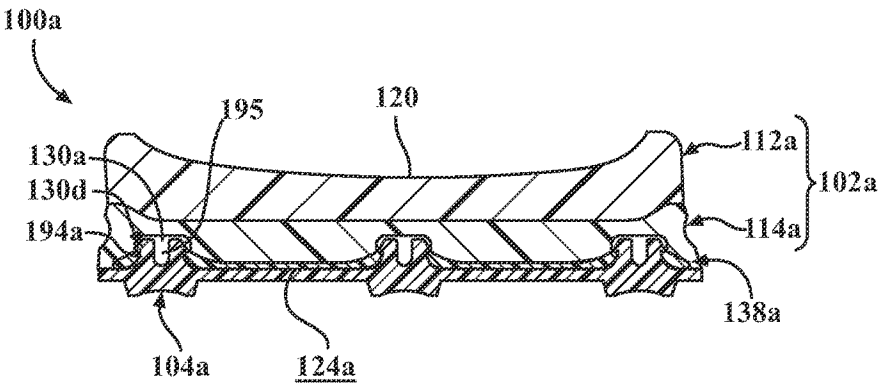
FIG. 22B is a cross-sectional view of the sole structure of FIG. 18, taken along Line 22-22 in FIG. 18 and showing the outsole of the sole structure attached to the midsole of the sole structure.
Figure 22A:
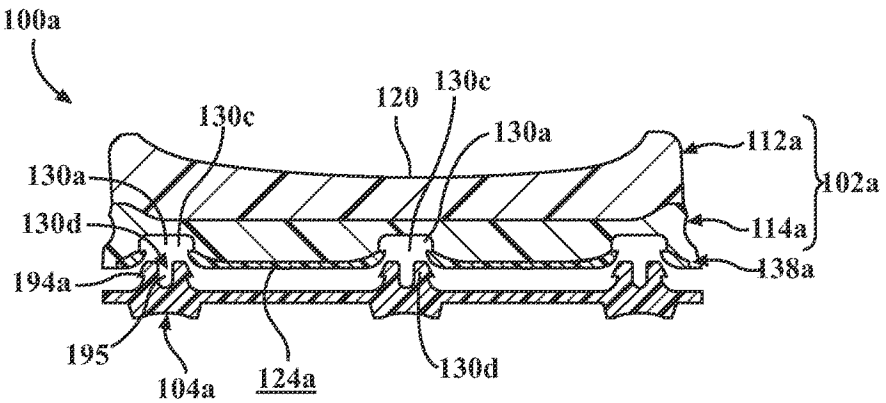
FIG. 22A is a cross-sectional view of the sole structure of FIG. 18, taken along Line 22-22 in FIG. 18 and showing an outsole of the sole structure detached from a midsole of the sole structure.
Figure 24:
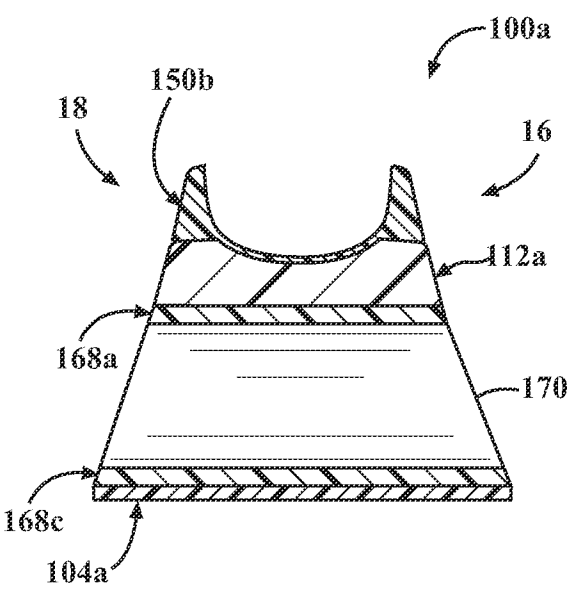
FIG. 24 is a cross-sectional view of the sole structure of FIG. 18, taken along Line 24-24 in FIG. 18.
Figure 23:
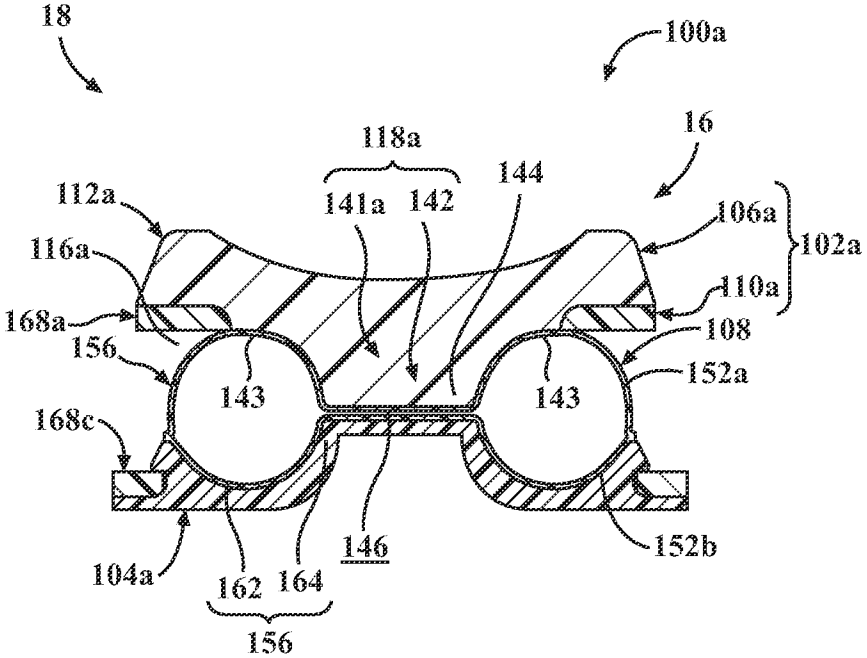
FIG. 23 is a cross-sectional view of the sole structure of FIG. 18, taken along Line 23-23 in FIG. 18.

Optionally, each of the pins 130*d* of the present example includes a flared barb 194*a* disposed at the distal end of pin 130*d*. The barbs 194*a* are configured to restrict disengagement of the pins 130*d* from the apertures 130*a*, 130*c* formed in the support member 114*a* and the plate 138. As shown in FIGS. 22A and 22B, each barb 194*a* flares from a minor dimeter at the distal end of the pin 130*d* to a major diameter in an intermediate portion of the pin 130*d*. Here, the minor diameter of the barb 194*a* may be smaller than a diameter of the aperture 130*c* formed in the plate 138*a*, while the major dimeter of the barb 194*a* is larger than the diameter of the aperture 130*c*. Thus, the minor diameter allows each pin 130*d* to be aligned within the aperture 130*c*. As shown in FIG. 22A, the bottom side of the plate 138*a* may be chamfered or radiused around the circumference of the aperture 130*c* to further facilitate alignment between the pin 130*d* and the aperture 130*c*. When the outsole 104*a* is installed on the sole structure 100*a* (FIG. 22B), the barb 194*a* is pushed fully through the aperture 130*c* and the major diameter of the barb interfaces with the plate 138*a* to retain the pin 130*d* within the apertures 130*a*, 130*c*. Optionally, the distal end of the pin 130*d* may include a relief 195 formed across a width of the pin 130*d*, which allows the barb 194*a* to flex radially inwardly when the barb 194*a* passes through the aperture 130*c*.

As provided above, the outsole 104*a* includes a pair of the fasteners 184*c*, 184*d* extending from opposite ends of the ground-engaging element 182. In the illustrated example, each of the fasteners 184*c*, 184*d* includes a tab 184*c*, 184*d* attached to an end of the ground-engaging element 182. In the present example, each of the tabs 184*c*, 184*d* includes a first material and the ground-engaging element includes a second material having. For instance, the tabs 184*c*, 184*d* may include a material having a different modulus of elasticity than the ground-engaging element 182 to facility stretching the tabs 184*c*, 184*d* over the ends of the chassis 106*a*. In other examples, the ground-engaging element 182 may include a material configured to provide more favorable ground-engaging characteristics (i.e., traction, abrasion resistance, hardness).

Generally, each of the tabs 184*c*, 184*d* is configured to be selectively secured to a respective one of the attachment points 148*a*, 148*b* of the chassis 106*a*. In the illustrated example, where the attachment points 148*a*, 148*b* are embodied as pins 148*a*, 148*b*, the tabs 184*c*, 184*d* include corresponding sockets or apertures 196*a*, 196*b* configured to interface with the pins 148*a*, 148*b* to secure the outsole 104*a* to the chassis 106*a*. Specifically, the heads of the pins 148*a*, 148*b* are pressed through the apertures 196*a*, 196*b* to attach the tabs 184*c*, 184*d* to each of the clips 150*a*, 150*b* of the chassis 106*a*. Optionally, each of the apertures 196*a*, 196*b* may include an annular reinforcement rib 197 extending around a circumference of the aperture 196*a*, 196*b* to provide increased strength, thereby preventing tearing during insertion and removal of the pins 148*a*, 148*b* through the apertures 196*a*, 196*b*. In the illustrated example, each tab 184*c*, 184*d* includes a series of the apertures 196*a*, 196*b*, which allows the outsole 104*a* to accommodate different sized chassis, carriages, and cushioning elements. For instance, the outsole 104*a* may accommodate a carriage and/or cushioning element having a different thickness by attaching a different one of the apertures 196*a*, 196*b* to the pins 148*a*, 148*b*.

Optionally, one or both of the tabs 184*c*, 184*d* may include a retainer 198 configured to maintain the tabs 184*c*, 184*d* against the upper 200 when the sole structure 100*a* is assembled. For example, one or both of the tabs 184*c*, 184*d* may include a fastener, such as a snap or hook-and-loop fabric, configured to attach to a corresponding fastener on the upper 200 to secure the tab 184*c*, 184*d* against the upper 200.

As set forth above, the article of footwear 10*a*, and particularly the sole structure 100*a* of the present disclosure, is configured as a modular structure, whereby components of the sole structure 100*a* are removably attached to each other such that one or more of the components can be easily interchanged with a corresponding component having different properties. For example, one or more of the outsole 104*a*, the bladder 108, or the carriage 110*a* may be detached from the chassis 106*a* and replaced with an alternative outsole, bladder, or carriage having different properties.

In use, the sole structure 100*a* is assembled by initially engaging the bladder 108 and the carriage 110*a* with the chassis 106*a*, as described above. To attach the carriage 110*a*, the lip 173 formed on the first end 172*c* of the lower frame 168*c* is presented to the slot 139 of the plate at an oblique angle (i.e., second ends 174*a*, 174*b* of the carriage 110*a* are angled away from recessed surface 128) and inserted through the slot 139 of the plate 138. With the lip 173 inserted into the slot 139, the carriage 110*a* is rotated up into the recess 116*a* about the lip 173 such that the first end 172*a* of the upper frame 168*a* of the carriage 110*a* is inserted into the slot 132 and the upper frame 168*a* is positioned against the recessed surface 128. Accordingly, the dock 118*a* is received through the opening 176*a* of the upper frame 168*a*.

With the carriage 110*a* attached to the chassis 106*a*, the bladder 108 can be engaged with the dock 118*a* by inserting the bladder 108 through the opening 176*b* formed in the lower frame 168*c* of the carriage. Here, the upper pocket 154*a* formed by the upper portion 152*a* of the bladder 108 is engaged with the dock 118*a* of the chassis 106*a* such that the ribs 144 are received between the conduits 164 of the bladder 108 and the cushions 162 are received within the channels 143. Here, the engagement of the channels 143 and the cushions 162 secures a lateral position of the bladder 108 while engagement of the ribs 144 and conduits 164 secures a longitudinal position of the bladder 108.

With the bladder 108 engaged with the dock 118*a*, the outsole 104*a* is attached to the midsole 102*a* to secure the bladder 108 and the carriage 110*a* within the recess 116*a*. Here, the first fastener 184*c* is attached at the anterior end 18 by inserting the first pin 148*a* through the aperture 196*a* of the first fastener 184*c*. The outsole 104*a* is secured to the support member 114*a* by inserting the barbed pins 130*d* formed on the inner surface 186 of the outsole 104*a* through the apertures 130*c* of the plate 138*a* and into the apertures 130*a* formed in the bottom surface 124*a* of the support member 114*a*. In the heel region 16, the cradle 190 disposed on the inner surface 186 of the outsole 104*a* is engaged with the lower portion 152*b* of the bladder 108 such that the lower spine 193 is received within the lower pocket 154*b* and the cushions 162 are received within the channels 192. The outsole 104*a* is secured at the posterior end 20 by inserting the second pin 148*b* through the aperture 196*b* formed in the second fastener 184*d*.

In use, the outsole 104*a* may be detached by pulling either of the fasteners 184*c*, 184*d* to disengage the fasteners 184*c*, 184*d* from the pins 148*a*, 148*b*. Any one of the outsole 104*a*, the cushioning element 108, and/or the carriage 110*a* can then be replaced with a different outsole 104*a*, cushioning element 108*a*, and/or carriage 110*a* to modify properties of the sole structure 100*a*.

The following Clauses provide exemplary configurations for an article of footwear, a bladder for an article of footwear, or a sole structure for an article of footwear described above.

Clause 1: A sole structure for an article of footwear having an upper, the sole structure including a chassis extending from an anterior end to a posterior end and including a dock formed between the anterior end and the posterior end, an outsole extending from a first end removably coupled to the anterior end of the chassis to a second end removably coupled to the posterior end of the chassis, and a cushioning element disposed between the chassis and the outsole and including a first portion removably engaged with the dock of the chassis.

Clause 2: The sole structure of Clause 1, further comprising a carriage removably disposed between the chassis and the outsole adjacent to the cushioning element.

Clause 3: The sole structure of Clause 2, wherein the carriage includes an upper frame engaged with the chassis and a lower frame engaged with the outsole.

Clause 4: The sole structure of Clause 3, wherein the upper frame surrounds the dock.

Clause 5: The sole structure of Clause 3 or 4, wherein the lower frame surrounds a portion of the outsole.

Clause 6: The sole structure of any one of Clauses 1-5, wherein the outsole includes a cradle formed between the first end and the second end, a lower portion of the cushioning element being removably engaged with the cradle.

Clause 7: The sole structure of any one of Clauses 1-6, wherein the chassis includes a support member spaced apart from the dock, the support member including a plurality of first engagement features and the outsole including a plurality of second engagement features selectively engaged with the first engagement features.

Clause 8: The sole structure of Clause 7, wherein the first engagement features are one of pins or apertures and the second engagement features are the other of pins or apertures.

Clause 9: The sole structure of Clause 8, wherein the pins include barbs.

Clause 10: The sole structure of any one of Clauses 1-9, wherein the anterior end of the chassis includes a first fixture for selectively attaching the first end of the outsole to the chassis and the posterior end of the chassis includes a second fixture for selectively attaching the second end of the outsole to the chassis.

Clause 11: A sole structure for an article of footwear having an upper, the sole structure including a chassis including a first portion forming a support member and a second portion defining a recess, the chassis having a dock disposed within the recess, an outsole extending from a first end removably coupled to the chassis adjacent to the first portion to a second end removably coupled to the chassis adjacent to the second portion, and a cushioning element disposed within the recess and including an upper portion removably engaged with the dock and a lower portion removably engaged with the outsole.

Clause 12: The sole structure of Clause 11, further comprising a carriage removably disposed between the chassis and the outsole adjacent to the cushioning element.

Clause 13: The sole structure of Clause 12, wherein the carriage includes an upper frame engaged with the chassis and a lower frame engaged with the outsole.

Clause 14: The sole structure of Clause 13, wherein the upper frame surrounds the dock.

Clause 15: The sole structure of Clause 13 or 14, wherein the lower frame surrounds a portion of the outsole.

Clause 16: The sole structure of any one of Clauses 11-15, wherein the outsole includes a cradle formed between the first end and the second end, the first portion of the cushioning element being removably engaged with the cradle.

Clause 17: The sole structure of any one of Clauses 11-16, wherein the support member includes a plurality of first engagement features and the outsole includes a plurality of second engagement features selectively engaged with the first engagement features.

Clause 18: The sole structure of Clause 17, wherein the first engagement features are one of pins or apertures and the second engagement features are the other of pins or apertures.

Clause 19: The sole structure of Clause 18, wherein the pins include barbs.

Clause 20: The sole structure of any one of Clauses 11-19, wherein the first portion of the chassis includes a first fixture for selectively attaching the first end of the outsole to the chassis and the second portion of the chassis includes a second fixture for selectively attaching the second end of the outsole to the chassis.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear having an upper, the sole structure comprising:

a chassis extending from an anterior end to a posterior end and including a dock formed between the anterior end and the posterior end, the dock including a series of elongate ribs extending from a lateral side of the sole structure to a medial side of the sole structure;

an outsole extending from a first end removably coupled to the anterior end of the chassis to a second end removably coupled to the posterior end of the chassis;

a cushioning element disposed between the chassis and the outsole and including a first portion removably engaged with the dock of the chassis, the first portion defining an upper pocket that receives the series of elongate ribs of the dock; and a carriage disposed between the chassis and the outsole, the carriage including a pair of frames spaced apart from and connected to each other by a flexure.

2. The sole structure of claim 1, wherein the carriage is removably disposed between the chassis and the outsole adjacent to the cushioning element.

3. The sole structure of claim 2, wherein the pair of frames includes an upper frame engaged with the chassis and a lower frame engaged with the outsole.

4. The sole structure of claim 3, wherein the upper frame surrounds the dock.

5. The sole structure of claim 3, wherein the lower frame surrounds a portion of the outsole.

6. The sole structure of claim 1, wherein the outsole includes a cradle formed between the first end and the second end, a lower portion of the cushioning element being removably engaged with the cradle.

7. The sole structure of claim 1, wherein the chassis includes a support member spaced apart from the dock, the support member including a plurality of first engagement features and the outsole including a plurality of second engagement features selectively engaged with the first engagement features.

8. The sole structure of claim 7, wherein the first engagement features are one of pins or apertures and the second engagement features are the other of pins or apertures.

9. The sole structure of claim 8, wherein the pins include barbs.

10. The sole structure of claim 1, wherein the anterior end of the chassis includes a first fixture for selectively attaching the first end of the outsole to the chassis and the posterior end of the chassis includes a second fixture for selectively attaching the second end of the outsole to the chassis.

11. A sole structure for an article of footwear having an upper, the sole structure comprising:

a chassis including a first portion forming a support member and a second portion defining a recess, the chassis having a dock disposed within the recess and including a series of elongate ribs extending from a medial side of the sole structure to a lateral side of the sole structure;

an outsole extending from a first end removably coupled to the chassis adjacent to the first portion to a second end removably coupled to the chassis adjacent to the second portion;

a cushioning element disposed within the recess and including an upper portion removably engaged with the dock and a lower portion removably engaged with the outsole, the upper portion defining an upper pocket that receives the series of elongate ribs of the dock; and a carriage disposed between the chassis and the outsole, the carriage including a pair of frames spaced apart from and connected to each other by a flexure.

12. The sole structure of claim 11, wherein the carriage is removably disposed between the chassis and the outsole adjacent to the cushioning element.

13. The sole structure of claim 12, wherein the pair of frames includes an upper frame engaged with the chassis and a lower frame engaged with the outsole.

14. The sole structure of claim 13, wherein the upper frame surrounds the dock.

15. The sole structure of claim 13, wherein the lower frame surrounds a portion of the outsole.

16. The sole structure of claim 11, wherein the outsole includes a cradle formed between the first end and the second end, the lower portion of the cushioning element being removably engaged with the cradle.

17. The sole structure of claim 11, wherein the support member includes a plurality of first engagement features and the outsole includes a plurality of second engagement features selectively engaged with the first engagement features.

18. The sole structure of claim 17, wherein the first engagement features are one of pins or apertures and the second engagement features are the other of pins or apertures.

19. The sole structure of claim 18, wherein the pins include barbs.

20. The sole structure of claim 11, wherein the first portion of the chassis includes a first fixture for selectively attaching the first end of the outsole to the chassis and the second portion of the chassis includes a second fixture for selectively attaching the second end of the outsole to the chassis.

* * * * *